United States Patent [19]

Guenther et al.

[11] Patent Number: 4,877,346

[45] Date of Patent: Oct. 31, 1989

[54] SHEET FEED HOPPER FOR INSERTION MACHINE

[75] Inventors: Kenneth L. Guenther, Park Ridge; Karavattuveetil G. Rabindran, Morton Grove; Thomas J. Faber, Skokie; Jack S. Abrams, Arlington Heights, all of Ill.

[73] Assignee: Bell & Howell Company, Chicago, Ill.

[21] Appl. No.: 151,200

[22] Filed: Feb. 1, 1988

[51] Int. Cl.[4] ..... B41J 13/10

[52] U.S. Cl. ..... 400/624; 74/89.2; 400/708; 221/6

[58] Field of Search ..... 400/708, 711, 624, 629; 74/89.3, 88.22, 501 R, 501 C, 501 F, 501.5; 271/258, 265, 145, 165, 167; 116/215; 221/6

[56] References Cited

U.S. PATENT DOCUMENTS

| | | | |
|---|---|---|---|
| 1,393,964 | 10/1921 | Potts et al. | 116/215 |
| 3,157,062 | 11/1964 | Howard | 74/501.5 |
| 3,838,663 | 10/1974 | Focke | 221/6 |
| 4,278,182 | 7/1981 | Ahlström | 221/6 |
| 4,407,597 | 10/1983 | Kapp | 400/629 |
| 4,570,761 | 2/1986 | Inoue | 74/89.2 |
| 4,582,312 | 4/1986 | Abrams et al. | 270/1.1 |
| 4,712,783 | 12/1987 | Selak | 271/165 |

*Primary Examiner*—David A. Wiecking

*Attorney, Agent, or Firm*—Laff, Whitesel, Conte & Saret

[57] ABSTRACT

An improved printing apparatus for printing preselected indicia on an envelope or other documents to be placed on a transport raceway of an insertion machine.

5 Claims, 23 Drawing Sheets

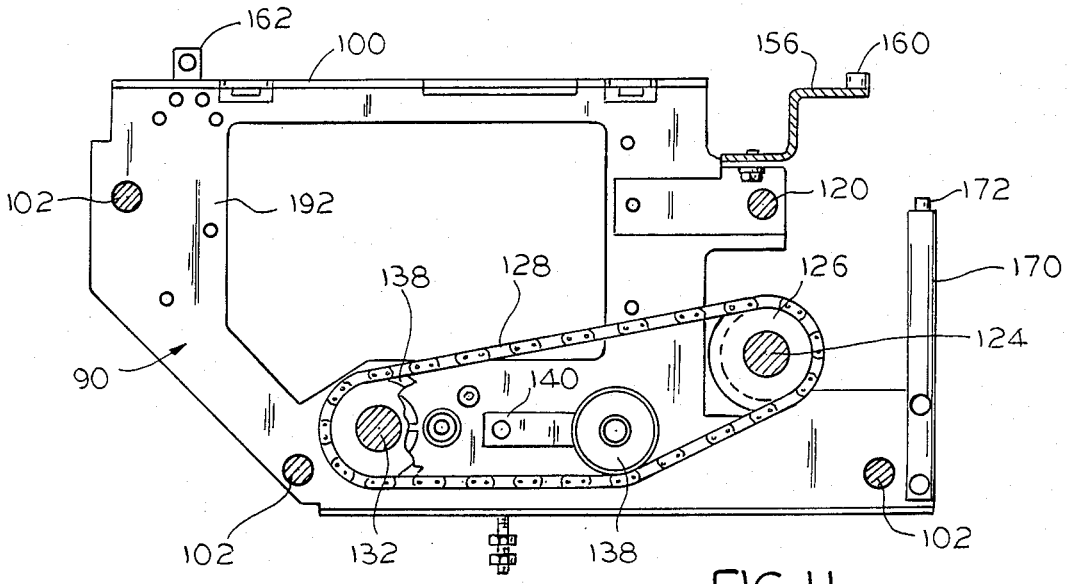
FIG. 11
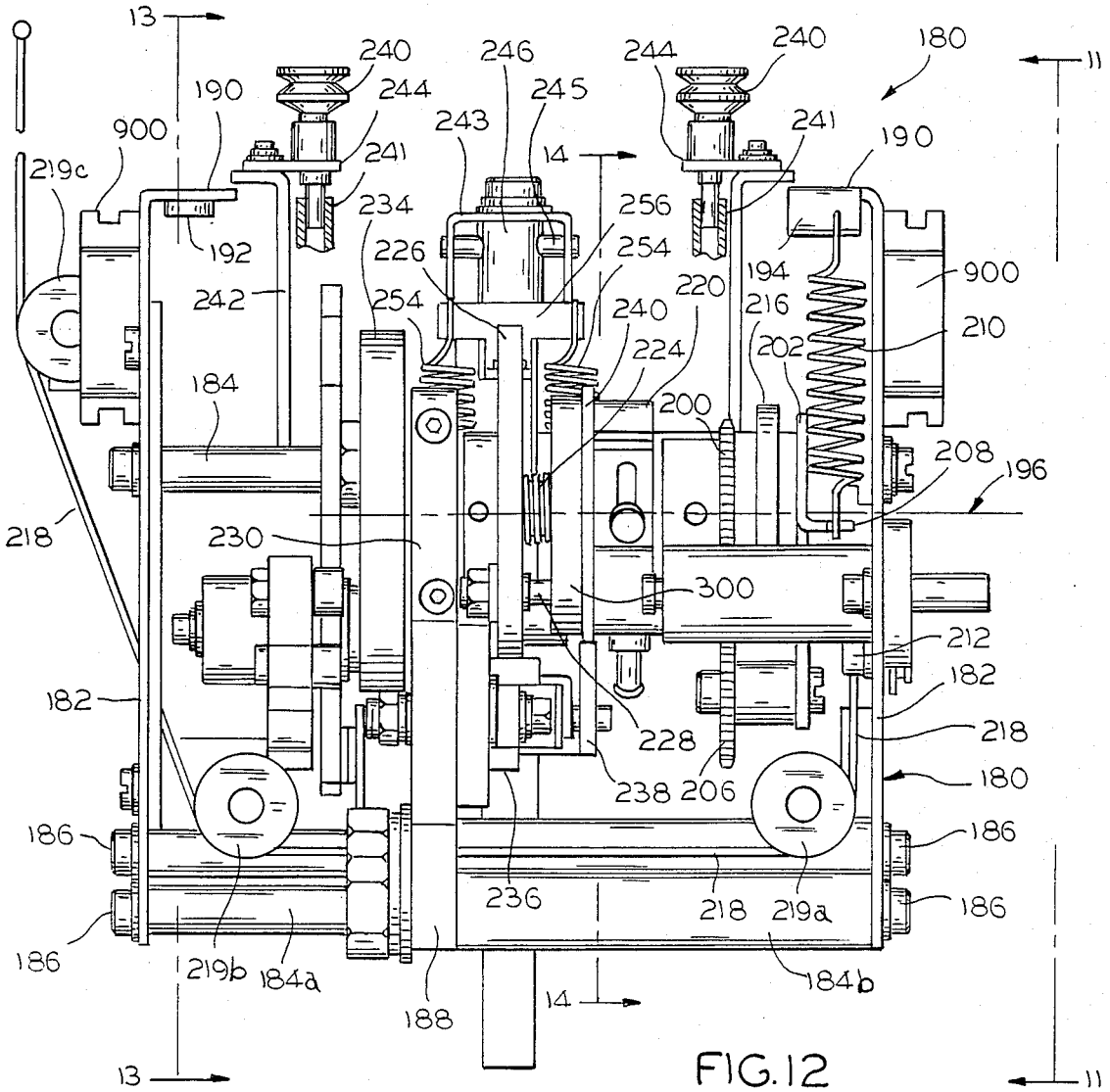

SHEET FEED HOPPER FOR INSERTION MACHINE

The present invention relates to an improved printing apparatus used in association with an insertion machine, and more particularly to an apparatus for printing a variety of bar codes or other indicia on a series of return envelopes or other documents prior to automatically inserting each such return envelope or other, documents in a mailing envelope.

BACKGROUND OF THE INVENTION

Samples of insertion machines of the type with which the present invention is designed to be synchronously coupled are disclosed in U.S. Pat. Nos. 2,325,455; 3,368,321; in assignee's U.S. Pat. No. 4,604,849 entitled INSERTION MACHINE and in assignee's U.S. Pat. No. 4,582,312 entitled PRINTING APPARATUS FOR INSERTION MACHINE.

An insertion machine of the type referred to above is adapted to collect a plurality of inserts and deposit them into a single pile and transport that pile to a stuffing station, simultaneously convey an open envelope to the same stuffing station, and then stuff the pile of inserts into the envelope. The envelope with inserts inside is then sealed and processed for mailing. It can be appreciated that all operating elements of the insertion machine are synchronously timed in accordance with a given machine cycle.

The operation of such devices can be defined in greater detail by referral to the above-indicated patents.

One use of the insertion machine is to prepare monthly billing statements to be sent to users of credit systems. In a typical system, the billing statements are computer generated on continuous form paper. The mailing envelope received by such credit system users may include that particular billing statement plus several addition documents advertising other products or services and usually a return envelope.

The person or entity preparing the envelopes containing the computer generated monthly billing statements may desire to encode the return envelope with certain indicia, denoting special circumstances noted in the billing statement such as significant payment receipts, delinquent accounts, dating of receivables, or the like. This information can be encoded in a "bar code" on one side of the envelope, the bar code comprising a series of long and short bars of varying widths, for example, which can be printed on each return envelope prior to its being gripped for delivery and insertion at a station on the transport raceway. Since the data to be placed on each return envelope will vary, depending on the status of each individual account represented by the specific statement placed in the mailing envelope, it is desirable to provide an insertion machine which has the capability of imprinting a different bar code on each envelope, if necessary, and to synchronize the printing of the individualized bar code with data appearing on each individual statement. In an exemplary apparatus, the data to be imprinted on the return envelope is derived from an optically-scanned format of the billing statement itself. This information is transmitted electronically or optically to the printing apparatus which imprints the appropriate bar code on the return envelope which will eventually be inserted into a billing envelope with its corresponding billing statement.

By imprinting the return envelopes with specified indicia, these return envelopes are capable of rapid and efficient sorting upon receipt by the payee. Thus, by providing a device for imprinting information in the form of a bar code, or other indicia, on a return envelope, down stream return sorting capability by the payee, for example, is greatly enhanced.

SUMMARY OF THE INVENTION

While the printing apparatus disclosed in U.S. Pat. No. 4,582,312, owned by the present assignee, discloses a printing unit which will functionally carry out the various objects enumerated hereinabove, it is the intent of the present invention to provide an improved printing apparatus which can be readily assembled, economically fabricated, and which has improved operating characteristics over those presented by the device set forth in assignee's U.S. Pat. No. 4,582,312.

More specifically, applicant is desirous of providing a device which has an improved frame assembly that is lighter in weight and which maintains aligned rigidity in spite of the reduction in materials. Also provided is a transporter mechanism which is unique and which differs from the prior art known to applicant.

In the previous printing devices a sucker was utilized to dislodge envelopes from a given orientation. A mere physical removal of the envelope from the sucker was accomplished by brushing it against a base plate. In the present apparatus, however, a unique rotary plate valve is provided that clearly cuts off the suction or negative pressure, and provides a positive release of the gripping action normally provided by the sucker against an envelope or document.

A further object is a modified oscillating beam mechanism that incorporates a bell crank as part of a unique transporter mechanism incorporating a light weight carriage that supports a pusher means that operates synchronously with the sucker means for movement of documents across the base plate and into a positional relationship specifically desired for imprinting the bar code by a printing mechanism.

The present invention additionally utilizes an improved stack means, i.e. hopper, that has a support means which readily releases the lowermost document or envelope from the stack at a predetermined attitude when the sucker is applied thereto. A pendulum-type sensor mechanism alerts the operator to an anticipated emptiness in the stack.

The unique arrangement of the hopper permits the hopper and print module to be tipped to facilitate removal of possible jams. The upper and lower frame means utilize a counter-balancing cam and spring loaded cam follower that support the upper frame during tipping when the cam follower has gone over-center on the cam.

The upper frame means also carries a modular printing means of the type similar to that found in U.S. Pat. No. 4,582,312.

Still another feature found in the present invention is a flexible control means that utilizes a unique termination means wherein undue stresses on the flexible control means are eliminated adjacent its termination and thereby increasing its useful life.

BRIEF DESCRIPTION OF DRAWINGS

Further objects of the present invention will be understood when the attached specification is read in the light of the attached drawings; wherein:

FIG. 11 is an elevational view in partial section taken along line 11—11 of FIG. 6;

FIG. 12 is an elevational end view of the hanging frame assembly which is carried by the fixed frame assembly and its associated platen and breaker plate;

DETAILED DESCRIPTION OF INVENTION

Figures 1, 2:
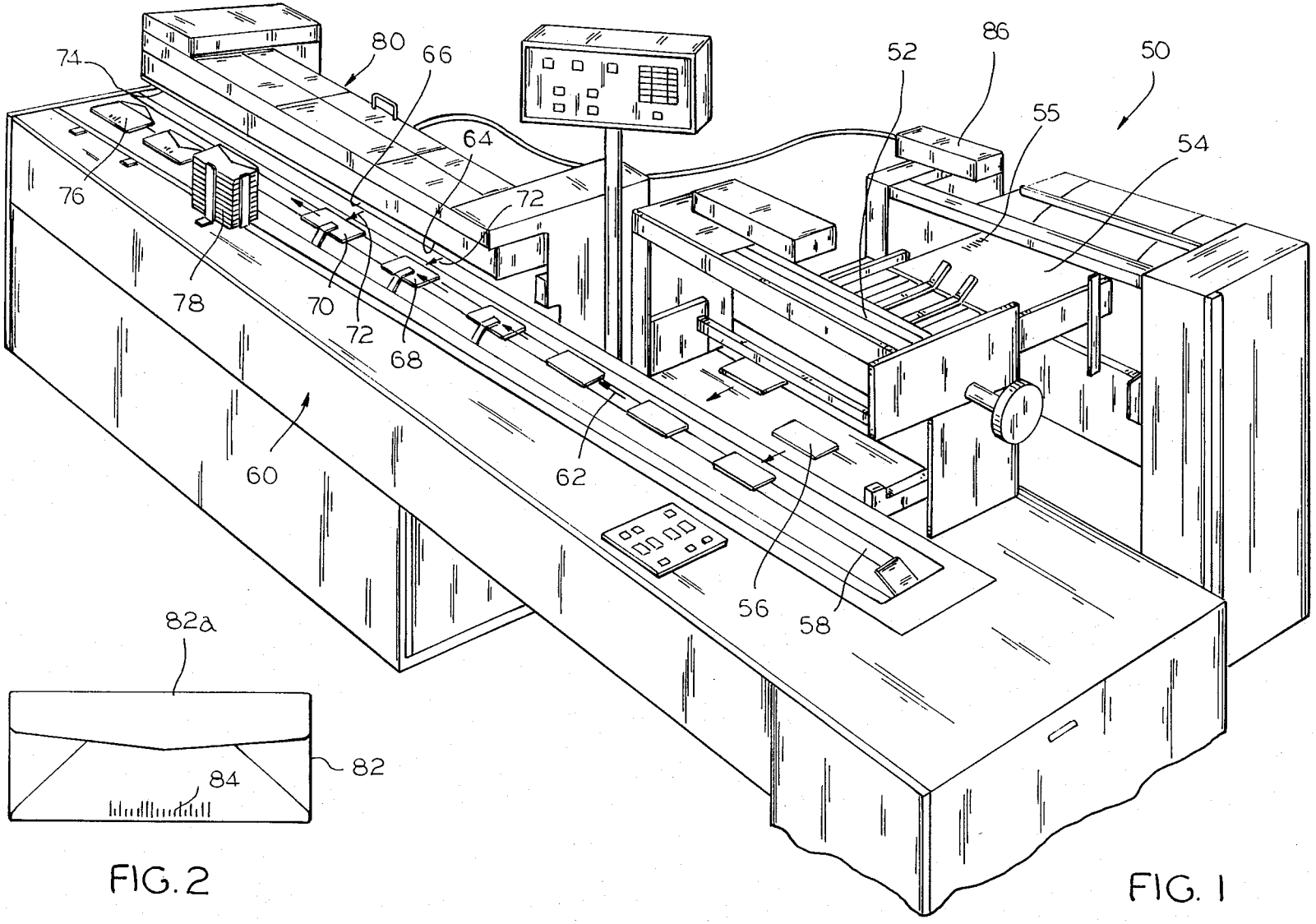
FIG. 1 is a perspective view of an insertion machine including the station for feeding computer generated documents such as billing statements to the transport raceway of the insertion machine, a connection to carry a signal from an optical scanner adjacent the billing statements to a printing apparatus at another station of the insertion machine where a bar code is imprinted on a return envelope, and a stack of billing envelopes into which the inserts on the transport raceway, including a printed return envelope, are ultimately stuffed.
FIG. 2 is a plan view of the rear of an envelope upon which a bar code has been imprinted.

Referring now to the drawings wherein similar parts are designated by similar numerals; FIG. 1 discloses a stylized computerized automated mailing system, generally designated by the numeral 50, in association with which the insertion machine and the printer apparatus of the preferred embodiment of the present invention is utilized. The mailing system 50 includes several major elements, including a pin feed cutter 52 which takes preprinted continuous form computer generated billing statements 54 which are cut, trimmed, folded and delivered as at 56 on a transport raceway 58 of an insertion machine which is generally designated by the numeral 60. The folded billing statements 56 are intermittently transported along raceway 58 in the direction shown by the arrows 62 past a plurality of insert stations 64, 66. As each billing statement 56 stops momentarily in front of an insert station 64, 66, in insert documents 68, 70 are selectively removed from a stack of insert documents (not shown) at each insert station and deposited atop the billing statement 56 on transport raceway, 58 which is in front of that particular insert station. The insert documents are selected in response to code marks printed on the statement 56. The insert documents 68, 70 are removed from their respective stacks one at a time and initially transported to raceway 58 in the direction shown by arrows 72, and each insert 68, 70 is also placed atop any other insert documents which may have been placed upon transport raceway 58 and billing statement 56 at a previous insert station.

Billing statement 56 with one or more insert documents 68, 70 stacked upon the billing statement, are eventually transported along raceway 58 to a stuffing station 74 of insertion machine 60, where each billing statement and insert document stack is stuffed into a waiting open mailing envelope as at 76. The envelopes are fed into a position adjacent stuffing station 74 from a hopper 78. After mailing envelope 76 is stuffed with its respective billing statement and insert documents, the mailing envelope and its contents are then transported to a sealing and metering station (not shown) for further processing.

The type of insert documents 68, 70 which are normally placed in the mailing envelopes may include promotional media or other products or services, delinquency notices to customers with overdue balances, special announcements such as credit term conditions and a return envelope for remittance of a balance due, or partial balance due. Complete details of the operation of an insertion machine such as designated by the numeral 60 may be found in U.S. Pat. No. 4,604,849 entitled INSERTION MACHINE DRIVE as well as an application for U.S. Letters Patent entitled GRIPPER ARM AND METHOD OF OPERATION filed Sept. 7, 1984, bearing Ser. No. 648,391 and having inventors Gary VanderSyde and K. George Rabindran, both the patent and application being assigned to the assignee of the present invention.

The printing apparatus which is a key element of the combination forming the present invention is diagrammatically designated in FIG. 1 by the numeral 80 and is adjustably attached to the insertion machine 60 at a location adjacent one of the insert stations as at 66.

The entire control system for the printing apparatus is in communication with electronic fiber optical scanning and computing device 86 by means of suitable electrical conduits and electronic circuitry. Optical scanner 86 is adapted to read suitable marks, such as bar codes 55 located along the edges of computer generated billing statements 54.

In a preferred embodiment of the present invention the marks are arranged in a binary pattern and "instruct" the control system for the printing apparatus as to what specific bar code is to be imprinted on a side of a return envelope, or other documents, depending on the manner in which the envelopes are stacked in the feed means for the printing apparatus 80, as will be explained. Optical scanner 86 is also adapted to control additional functions of the entire automatic inline mailing system 50 in response to either the bar code marks 55, or other suitable indicia, for example to selectively control which insert documents will be added to each billing statement. One suitable scanner is described in U.S. Pat. No. 4,442,347, entitled INDICIA READING METHOD AND APPARATUS.

FIG. 2 illustrates a return envelope 82 of the type which is to be inserted into mailing envelopes 78 at stuffing station 74. Envelope 82 is imprinted with a bar code 84 which in the preferred embodiment consists of a linear array of long and short lines which form a binary source of data. The bar code can represent current, 30, 60, or 90 day accounts, for example. When the return envelope 82 is submitted to the payee with a creditor's remittance, the imprinted side of the envelope may be optically scanned, sorted and processed. This procedure saves significant amounts of payee's time and labor in categorizing and channeling return remittances in large credit institutions.

The present invention relates primarily to an improved apparatus for automatically imprinting the return envelope 82 with a bar code 84 and synchronizing the application of the appropriate bar code with information generated by an optically scanning device of the type shown schematically at 86 from a computer generated billing statement 54.

Directing your attention now primarily to the printing apparatus 80, such a device basically includes a fixed frame assembly 90 enclosing and supporting a hanging frame assembly 180 in its lower regions with the latter comprising, basically, the major mechanization for mechanically operating the device. Supported on the upper surface of the fixed frame assembly 90 is a top support plate 370 which in turn serves as a work surface for the upper frame that is adapted to carry the supply or hopper and printing module assemblies.

Figure 6:
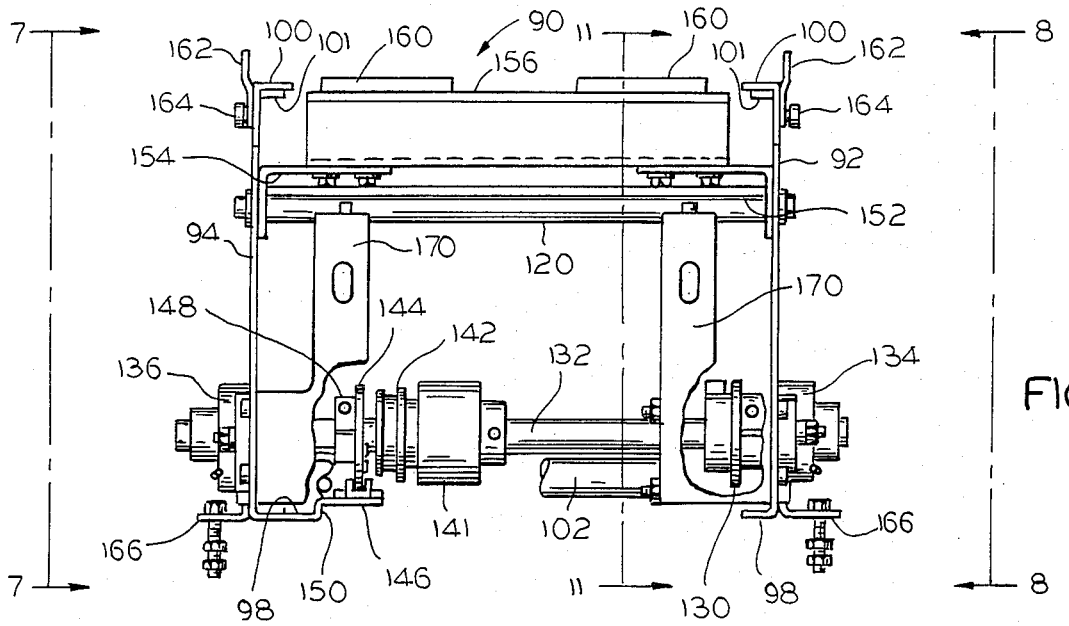
FIG. 6 is an end view of the lower fixed frame assembly as viewed along line 6—6 of FIG. 7.
Figure 7:
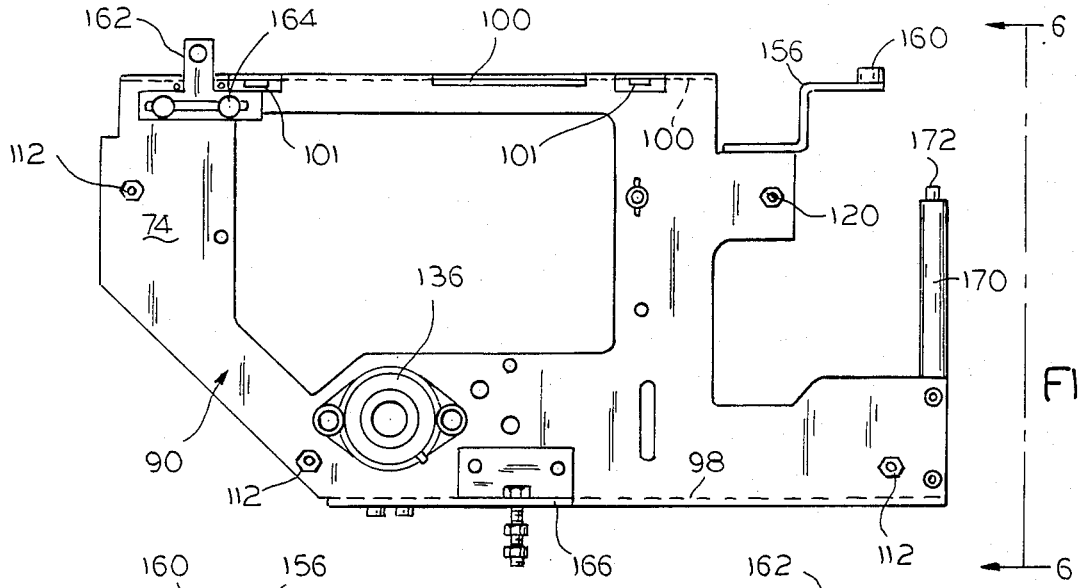
FIG. 7 is a side elevational view of the fixed frame assembly as viewed along line 7—7 of FIG. 6.
Figure 8:
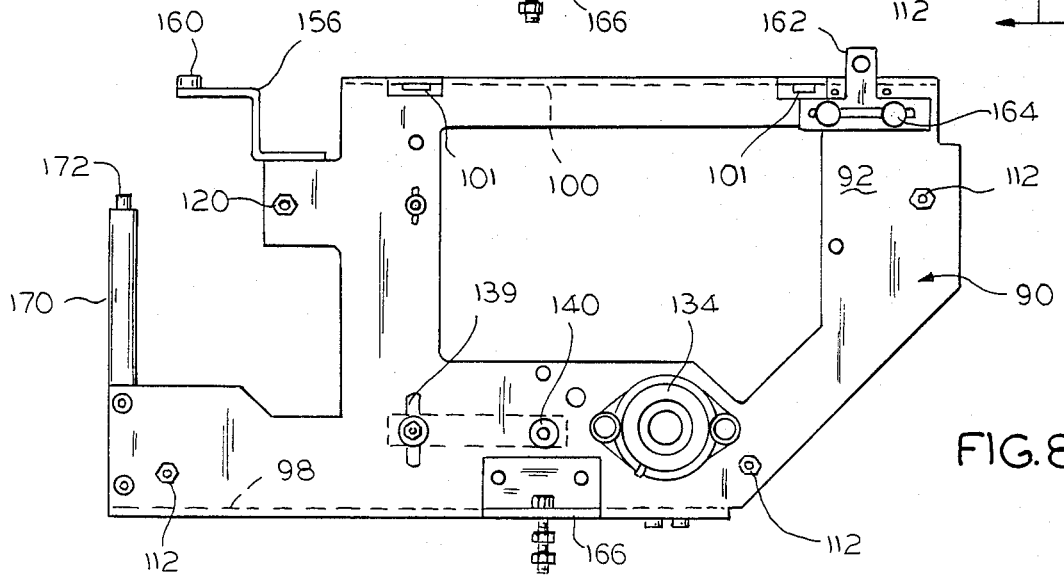
FIG. 8 is a side elevational view of the opposite side of the fixed frame assembly as viewed along line 8—8 in FIG. 6.
Figure 9:
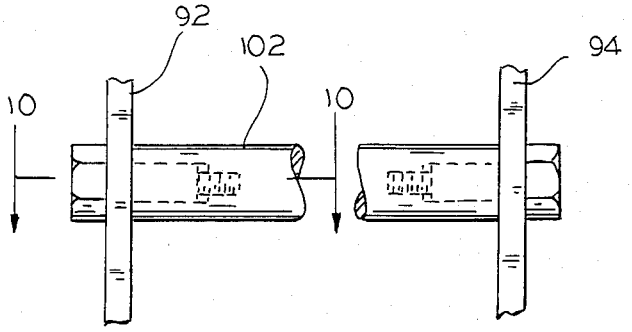
FIG. 9 is a partial view in elevation of the tie rods used in assembling the fixed frame.
Figure 10:
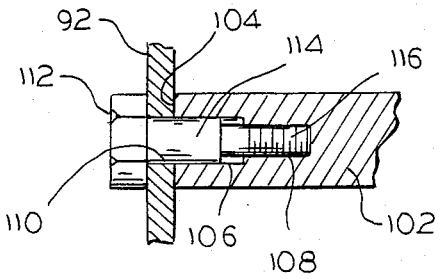
FIG. 10 is an elevational view in partial section taken along line 10—10 of FIG. 9.

Referring now to FIGS. 3–11 the fixed frame 90 includes a unique construction. Where prior devices for performing similar functions utilized cast frames and were extremely heavy in nature, this invention utilizes heavy sheet stampings, forming a right hand assembly 92 and a left hand assembly 94 (FIGS. 6–8). These stampings are substantially mirror images of one another, with a few exceptions. They both include inwardly directed flanges along their bottom as well as at their upper edges, designated 98 and 100, respectively (FIGS. 6, 7). The two flanges maintain substantial rigidity to the sheet material in a longitudinal direction and also serve other structural functions as will be pointed out hereinafter. To maintain the right and left hand fixed frame assemblies 92, 94 in rigid spaced relation, a plurality of rigid spacer locators are used which are designated by the numeral 102 (FIGS. 6, 9, 10). Each of these locators 102, as best seen in FIGS. 9 and 10, have machined or ground ends 104 that are substantially perpendicular to the axis of the rod. In each machined or ground end face 104 there is placed a co-axial counterbore 106 of a predetermined diameter that terminates in a threaded bore 108. The frame is provided with a plurality of spaced apertures 110 having substantially identical diameters to the counterbore 106. The counterbore 106 has a predetermined depth which terminates in the threaded portion 108. A shoulder bolt 112 is provided with an unthreaded portion 114 that is substantially identical in diameter to the aperture 110 in the plates 92–94, and is also substantially identical to the counterbore 106 thereby giving a positive locating ability to the bolt 112. The bolt also includes a reduced threaded extremity 116 which complimentarily engages the threaded bore 108. The unthreaded portion 114 has a length less than the axial depth of counterbore 106 whereby the shoulder bolt 112 with its appropriate enlarged head form can pull the rod 102 into tight facing engagement with the side assembly frame members 92 and 94. By precisely grinding or machining the rod 102 it is possible to obtain an accurate spacing of the frame members as well as to maintain positive rigidity and alignment in configuration. The bolts 102 are plural in number and in the presently disclosed embodiment they are located at three spaced locations. A fourth, substantially identically designed spacer-type bar, of a lesser diameter, designated by the numeral 120 (FIGS. 6–8), is located in still another quadrant of the frame and provides rigidity at that upper position.

Referring to FIGS. 1, 3, 5, 6 and 11, the lower fixed frame 90 connects with a source of power by drawing on the power drive shaft 124 of the inserter machine 60. The shaft 124 carries a sprocket 126 that engages a power take off timing chain 128 that cooperatively engages a second sprocket 130 mounted on a shaft 132 that extends between opposite side walls of frame 90 and is supported at opposite ends by the fixed bearings 134 and 136 respectively (FIGS. 6–8). The chain 128 is maintained in a taut condition by an adjustable idler 138 that pivots about a point 140 and is maintained in a predetermined disposition by an external slot 139, as best seen in FIG. 8. The shaft 132 also includes an overload clutch and sprocket assembly 141 (FIG. 6) that includes a sprocket 142 and adjacent thereto a flagged start-of-print indicator wheel 144 that passes between a P.C. board encoder or photosensor 146 supported and positioned adjacent to an adjustable hub interrupter 148 with the P.C. board encoder 146 being supported by the start-of-print interrupter bracket 150. The function and purpose of these latter items will be discussed hereinafter.

From a structural standpoint, with reference to FIG. 6, the side walls are provided with inwardly directed brackets 152–154 that support an offset angle iron truss fixed frame 156 which spans the opening between the angled brackets 152–154, and with frame 156 supporting on its upper edge a pair of spaced anvil pads 160. Extending upwardly from the outside edge of each of the sides is a slotted member having an upwardly extending finger 162 having a pair of adjusting screws 164. The upwardly extending finger 162 serves as a breaker plate keeper as will be explained hereinafter.

At the lower extremity of each wall are a pair of outwardly extending brackets 166 (FIGS. 3-6) that includes suitable fastening means and serves as the foot or support for the frame. Also supported at the lower edge are a pair of upwardly extending rigid members 170 that terminate in a set screw 172 (FIGS. 3, 5, 6, 7, and 8). These devices, along with the foot supports 166, serve to fasten the printing machine and the fixed frame assembly relative to the inserter machine 60 with which it is associated.

Thus, the present invention provides a light weight rigid frame member 90 which accepts transmitted power from the main machine power source, shaft 124, and connects the power to a common internal shaft 132 supported at each end by the bearings 134 and 136. This unique structure 90 is capable then of supporting the mechanical workings that are designated as the hanging frame assembly 180 (FIG. 12).

The hanging frame assembly 180 includes a pair of rigid side walls 182 that are maintained in spaced relationship by spacer rods 184, rods 184 being constructed along the same design as the spacer rods 102 were in the rigid frame. The side walls are maintained in spaced relationship by grinding or machining the ends of the spacer rods 184 to provide a predetermined length to rods 184, also providing a predetermined diameter counterbore and a reduced internal threaded portion which will accept a complimentary shoulder bolt 186 (FIG. 12) whose unthreaded portion is shorter than the counterbore which thereby permits take up by the threaded portion of bolt 186 until the sidewalls are seated on rods 184 to thereby establish the positive parallel aligned relationship of the side walls 182. There is one unique consideration in certain of these tie rods 184 in that the lower spacer rods 184, as seen in FIG. 12, have two different diameter sections namely **184*a* and 184*b*. The reason for this is that they must pass through, locate, and support a central structural member 188 that projects upwardly in parallel spaced relation to the side walls 182. Center member 188 supports one end of the main cam shaft 196 which operates within the confines of the walls 182**.

At the upper end of the walls 182 are inwardly directed flanges 190 (FIGS. 12, 13) which provide a means for carrying out several functions. For example, one function is to provide an extruded or captive nut means 192 and another is to provide a struck down tang 194 which is capable of accepting and supporting the end of a spring member 210, as seen to the right in FIG. 12. The flanges 190 include a plurality of nut-like members 192, for example, see the section in FIG. 16 which displays two of such nut members in spaced relation along the same flange 190 that utilizes the downwardly struck tang 194. The nut members 192 accept fastener means such as screws 193 through the top support plate 370 to maintain the hanging frame assembly in a positive substantially fixed arrangement relative to the top support plate.

It will be noted that the center line of the cam shaft which is the interrupted line designated by the numeral 196 (FIG. 12) carries a broad spectrum of items. Referring back to FIG. 16, the cam shaft 196 is connected to the fixed power shaft 132 by a chain belt means 198 and suitable sprockets 200 and the previously designated sprocket 142, which is coupled to the final power shaft 132 through an overload protection device 141, (See FIG. 6). This power take-off scheme, also includes a spring urged idler assembly 202. Idler assembly 202 basically is an L-shaped sheet metal member having a pivot 204 at the juncture of the two arms of the "L-shaped" bracket and an idler sprocket 206 at the extremity of one arm and a bent out tang 208 (partially on the back side) adapted to accept an extension spring 210 between the extremity 208 and the tang 194. In this fashion, the chain drive 198 is maintained in tight contact with the sprockets 142 and 200.

Figure 16A:
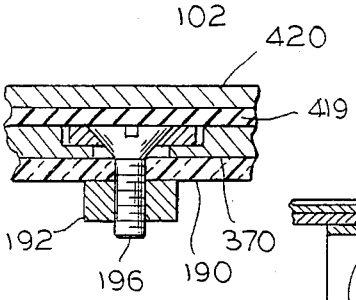
FIG. 16A is an enlarged sectional detail of the fastening means at the upper left corner of FIG. 16.
Figure 16:
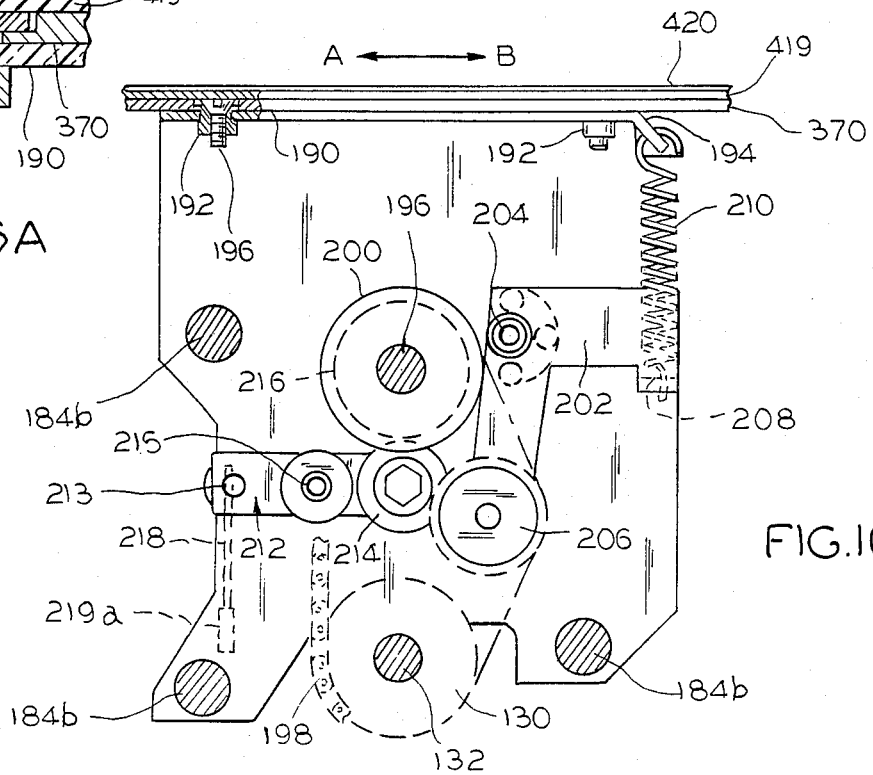
FIG. 16 is an elevational view in partial section of the power take-off mechanism for the hanging frame assembly as taken along line 16—16 of FIG. 4.

Another feature of the present invention which is present in FIG. 16 is the head lift subassembly 212 that includes a cam follower 214 acting against a head lift cam 216 which is shown in phantom behind the sprocket 200. At the opposite end of the arm 212 acting against pivot 215 is a connecting means 213 attached to a termination of the head lift control cable 218. The cable 218 extends downwardly and engages a sheave 219*a* and is redirected as will be seen in later descriptive matter.

Referring back now to FIG. 12 and FIG. 18, the head lift cam 216 is positioned adjacent to the sprocket means 200. Next, positioned inboard from the above elements, is a thrust washer 219 and then a novel face-type valve member with the body being designated 220. Specific details on the valve body 220 and other related parts will be amplified hereinafter, but at this time it is desired to merely state the order of progression or location of the parts on the cam shaft 196. Adjacent to the valve body 220 is an orifice plate 290 that is sealingly engaged by the valve rotor 300 which is spring urged toward orifice plate 290 by a coaxial spring 224. These are followed by the elevator feeder cam 226 which includes a drive pin 228 that is circumferentially adjustable within cam 226. The driver pin 228 engages a partial dead end bore in rotor 300 and provides the necessary rotation about cam shaft 196 for rotor 300. Appropriate bearing means 230 are connected to and support the cam shaft 196 as it progresses through the support 188. On the opposite side of the support is a cam shaft subassembly 234 which shall be described in greater detail hereinafter.

Figure 13:
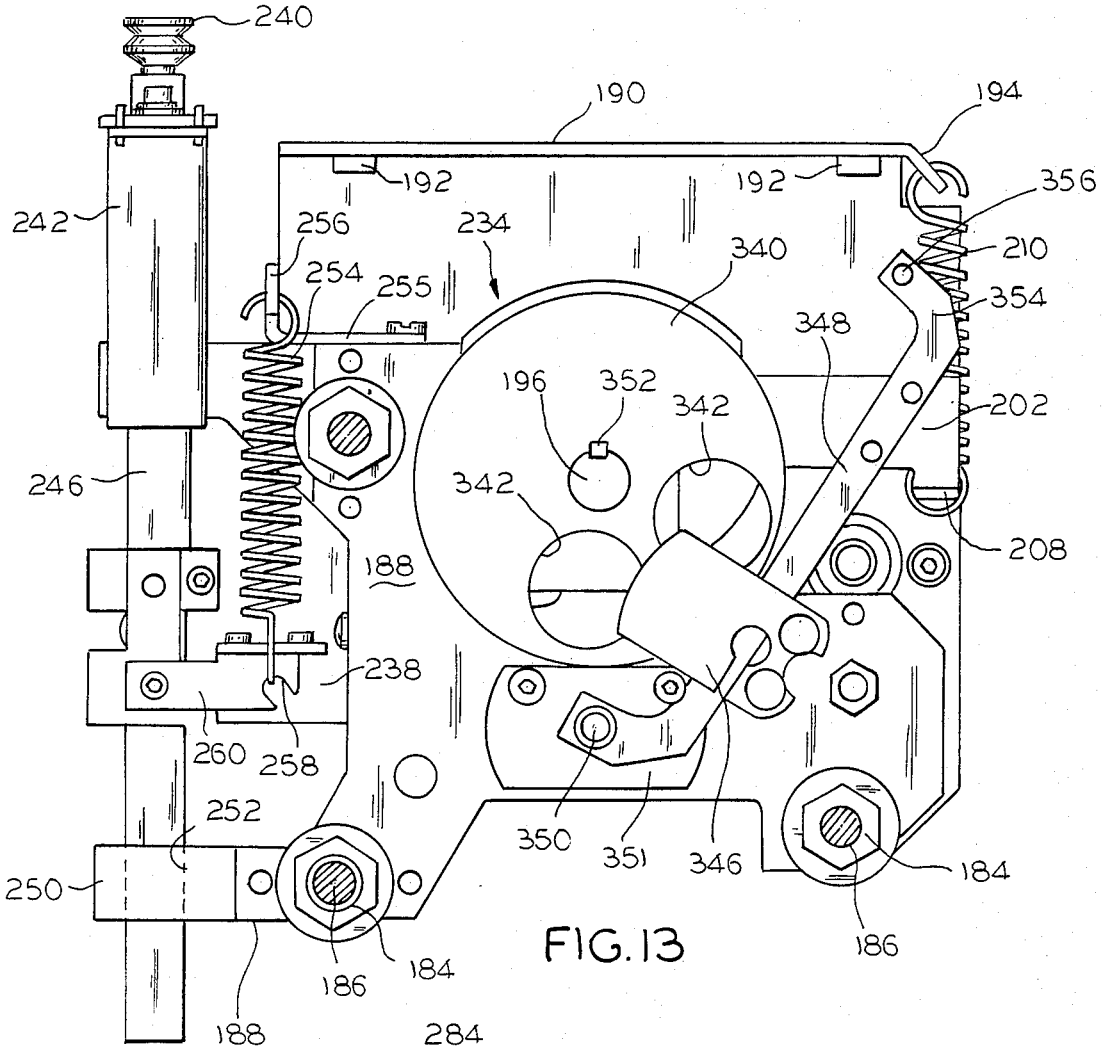
FIG. 13 is an elevational view in partial section taken along line 13—13 of FIG. 12.
Figure 14:
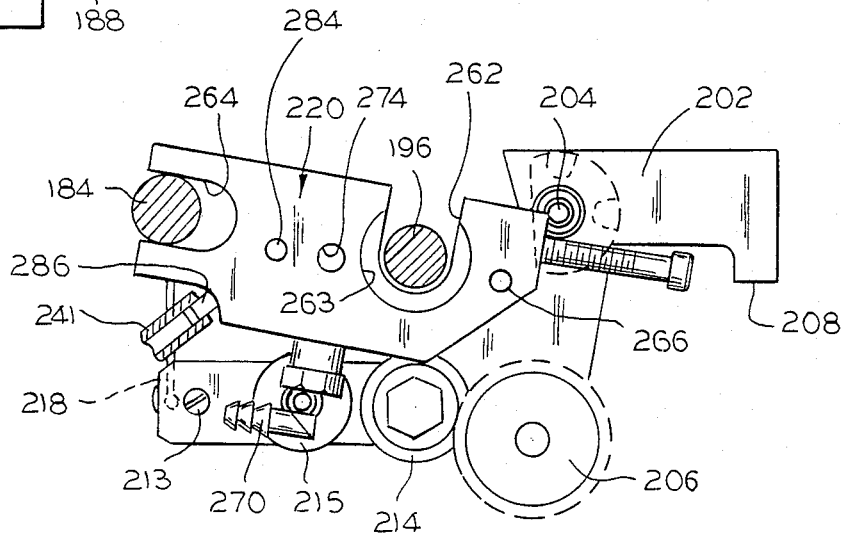
FIG. 14 is a partial elevational view in partial section as taken along line 14—14 of FIG. 12.

Projecting upwardly from one end of the hanging assembly are a pair of bellows suckers 240 (FIGS. 12, 13) which are attached to a pair of spaced brackets 242 having inwardly directed shelf-like support means 244. These brackets 242 are generally U-shaped with adjacent inner legs innerconnected as at 243 and supported by a pin 245 passing through central post-like member 246 thereby supporting the brackets 242 in a central location (as seen in FIG. 12). As best seen in FIG. 13, the suckers 240 are aligned beside one another on the tubular central portion 246, which supports the brackets 242. Portion 246 projects downwardly through an encircling supporting arm 250 having a through bore 252 to accommodate vertical motion therethrough, and upwardly through an encircling supporting arm 251 having a through bore 253 to accommodate vertical motion therethrough. The arms 250 and 251 with their bores 252 and 253 are a part of the central supporting member 188. The assembly is spring loaded in an upward direction by the spaced extension springs 254 which are each supported by the rigid bracket 255 having a T-shaped cross beam 256. The opposite end of the springs are captured in a groove 258 of a laterally extending flange 260 that acts upon the bracket 242 as it moves upwardly and downwardly on the shaft-like cylindrical portion 246. The elevator feeder cam 226 (FIG. 12) is eccentric relative to the cam shaft 196, and as it rotates it moves the offset cam follower 236 acting through lever 238 to move the cross brackets 242 of cylindrical portion 246 in a vertical direction and thereby, with the cooperation of springs 254, cause the bellow suckers 240 to reciprocate up and down as the cam shaft rotates, for purposes as set forth hereinafter.

To provide a source of negative pressure to the bellow sucker members 240 are a pair of hoses 241 that connect to an appropriate timed valve means such as that found in valve body 220.

Figure 22:
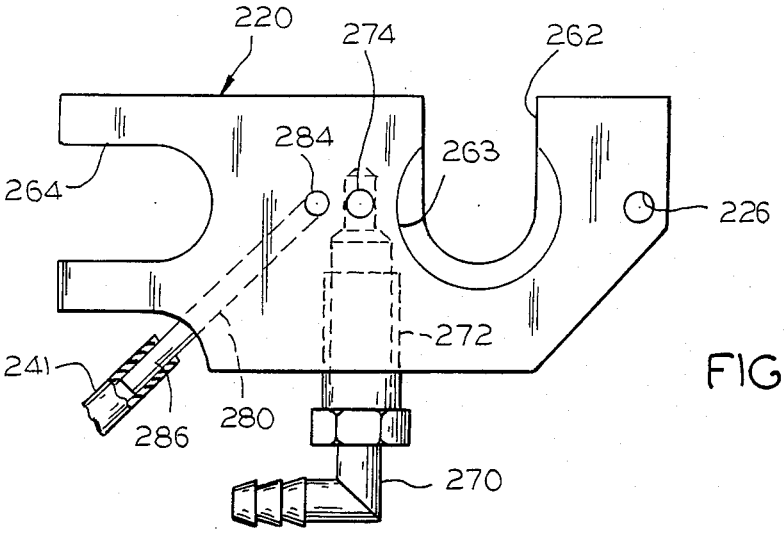
FIG. 22 is an elevational view in partial section of the housing for the vacuum valve with the subassembly of the fluid outlets associated therewith.
Figure 23:
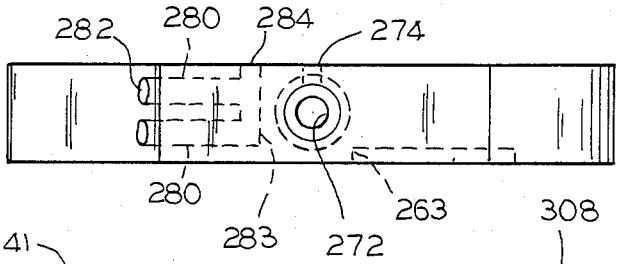
FIG. 23 is a top plan view of the valve housing shown in FIG. 21.

Referring now to FIGS. 14, 18 and 22–26, the valve body 220 is a generally rectangular shaped device having a pair of slots 262–264, the first of which 262, extends inwardly from the longitudinal edge and is face counterbored as at 263 (FIG. 22). The second slot 264 enters one end of the valve body 220, and adjacent the opposite end thereof is a blind bore 266, for purposes set forth hereinafter.

The valve body 220 accommodates a fitting 270 (FIGS. 14, 22) that communicates with a bore 272 connected to a lateral port 274. From adjacent the slotted one end of the valve body 220, and in an angular relationship thereto, a second pair of channels 280 communicate from openings 282 with a transverse bore 283 having a side port 284. The fitting 270 is connected to a source of negative pressure (not shown), and the channels 280 through their ports 282 are connected to appropriate tubes 286 that accept tubing 241 which is connected to the two bellows suckers 240 for purposes set forth hereinafter. As can be best seen in FIG. 26, the valve body 220 is provided with a circular orifice plate 290 having a central neck 293 acceptable within complimentary counterbore 263. Plate 290 is fixed against rotation relative to body 220 by suitable pin means 292 extending into the blind bore 266 of the valve body 220. The orifice plate 290 is provided with suitable bearing means 294 and valve body 220 is provided with bearing means 295 which permits both elements to remain fixed relative to each other and yet permits rotation of the cam shaft 196 therethrough. The valve body 220 has its slot 264 embracing the transverse tie rod 184 to thereby prevent the rotation of both body 220 and pinned orifice plate 290 relative to the hanging assembly 180.

Figure 26:
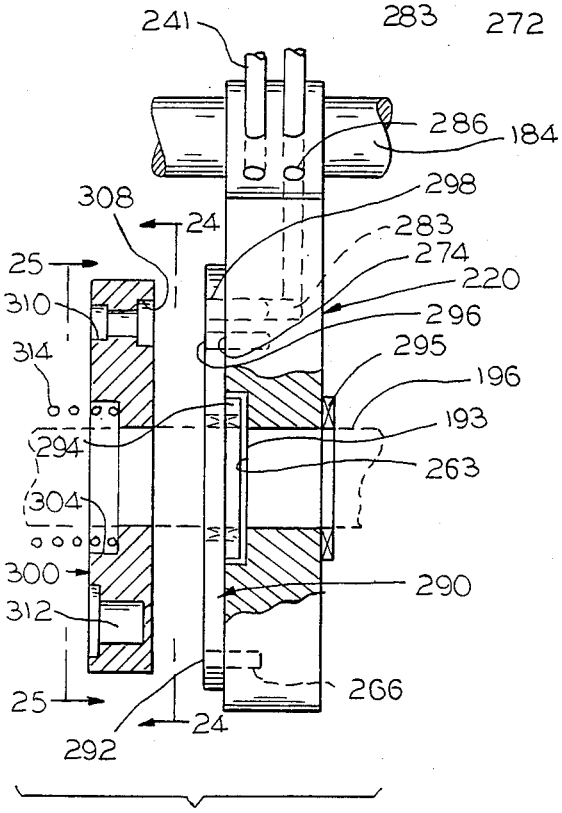
FIG. 26 is an exploded schematic partial section of the valve rotor as it is associated with the valve housing and an orifice plate, a spring member for urging the rotor into contact with the orifice plate, a schematic phantom view of the cam shaft on which they are mounted and the fixed rod which restrains rotation of the valve housing.

At the opposite side of the orifice plate 290 from pin 292 are a pair of through bores 296 and 298 (FIG. 26) which communicate with the side bores 274 and 284, respectively (FIG. 22). As mentioned above, the orifice plate 290 also includes a cylindrical extension 293 that is complementary to and resides within the counterbore 263 in the valve body 220 (FIG. 26).

Figure 24:
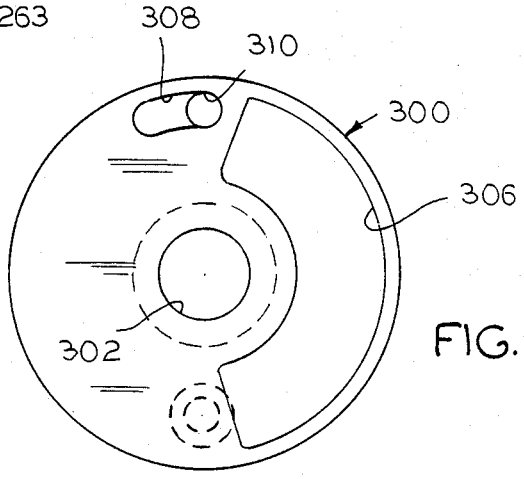
FIG. 24 is an elevational view of the vacuum valve rotor with relief ports in its face.
Figure 25:
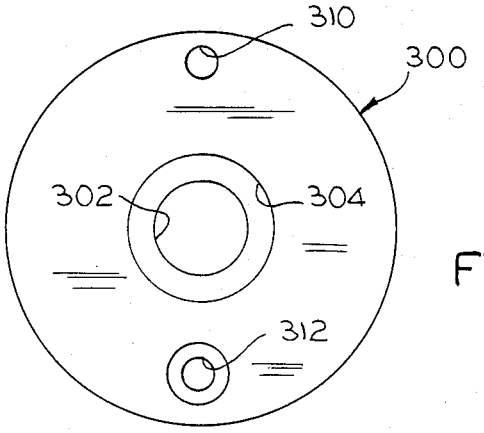
FIG. 25 is an elevational view of the reverse side of the vacuum valve rotor as viewed along line 25—25 in FIG. 26.

Positioned on the cam shaft 196 in sliding, sealing, rotating relation to the orifice plate 290 is the valve rotor 300. The rotor 300, as best seen in FIGS. 24–26 is a generally cylindrical body having a central through bore 302 with a counterbore 304 positioned on one face for purposes best set forth hereinafter. On the front face of the rotor 300 is an arcuate surface slot 306 which extends circumferentially over a limited extent of that face. Adjacent to the slot 306, but spaced therefrom is a second slot 308 having a more limited radial extent as well as a very limited circumferential extent. While slot 306 is a blind slot, slot 308 communicates with a through bore 310 for purposes as set forth hereinafter. Substantially directly opposite the slot 308 and on the opposite face of rotor 300 is a blind bore 310 which cooperatively accepts a drive pin 228 (FIG. 12) as will be set forth hereinafter. A spring means 314 is utilized to urge the rotor plate 300 into sealing engagement with the orifice plate 290. The spring means is seated within the rotor counterbore 304 and thereby prevented from lateral movement.

As the valve rotor 300 rotates relative to the orifice plate, the slot 306 permits the source of vacuum brought by the fitting 270 from a suitable source, not shown, into or through the port 274 and its communicating aperture 296 in the orifice plate into the confines of the slot 306. The slot 306 permits the negative pressure to cause a vacuum to be drawn through the port 298, the orifice 284 and thence along channels 280 and the appropriate fittings 286 hoses 241 going to the bellow suckers 240. The purpose in using this negative pressure will be explained in greater detail hereinafter. However, as the rotor 300 revolves about the cam shaft 196 under the influence of pin 228, slot 308 is brought into communication with aperture 298 and orifice 284, whereby slot 308 with its through bore 310 permits ambient air pressure to enter the tubing 286 and thereby relieve the vacuum on the bellow suckers 240. The circumferential disposition of the slots 306 and 308 is a critical feature to the operation of the device which will be described in greater detail hereinafter.

The described configuration of the rotary vacuum valve which is comprised of a valve body 220, orifice plate 290, and rotor 300 is unique in that it provides for easy removal of the valve body 220. This ease in disassembly permits ready access to the interior of body 220 for removal of dust, paper, mail nap, etc. commonly encountered in mail processing machinery, and commonly a problem in devices employing negative pressure such as this vacuum valve arrangement. It can be seen that the valve body 220 is not retained on the shaft 196. However, alignment of valve body 220 with the shaft 196 is important and is maintained by the cylindrical extension 293 of the orifice plate 290 which engages counterbore 263 in the valve body 220. The valve body 220 can be easily removed by first removing the vacuum tubing 241 from the extensions 286 communicating with vacuum ports 280. Then the orifice plate 290 is moved with rotor 300 against the force of compression spring 224 until the cylindrical extension 293 of the orifice plate disengages the counterbore 263 of the valve body. Slots 262 and 264 in valve body 220 permit removal of the valve body from the machine for cleaning without need for removal of shaft 196.

The blind bore 312 of rotor 300 is deep enough to permit drive pin 228 to proceed to the bottom of hole 312 a distance adequate to enable disengagement of cylindrical extension 293 from counterbore 263.

Figure 18A:
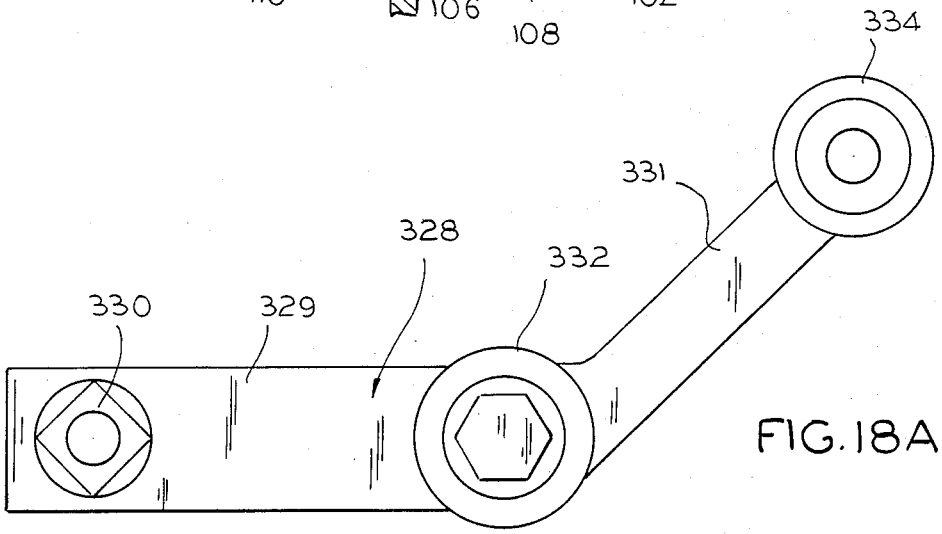
FIG. 18A is an elevational view of the head draw lever subassembly.
Figure 18B:
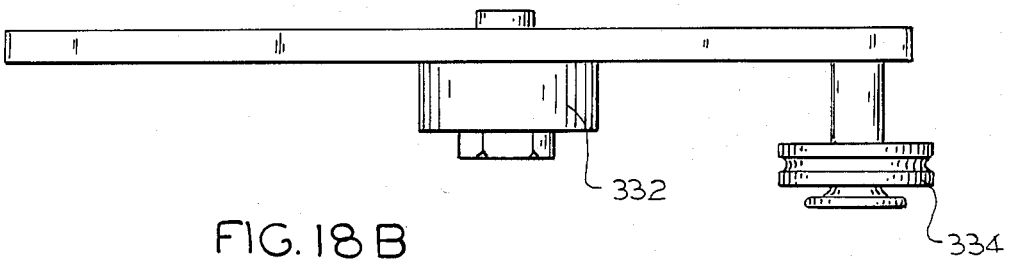
FIG. 18B is a top view of the same head draw lever subassembly shown in FIG. 18A.
Figure 17:
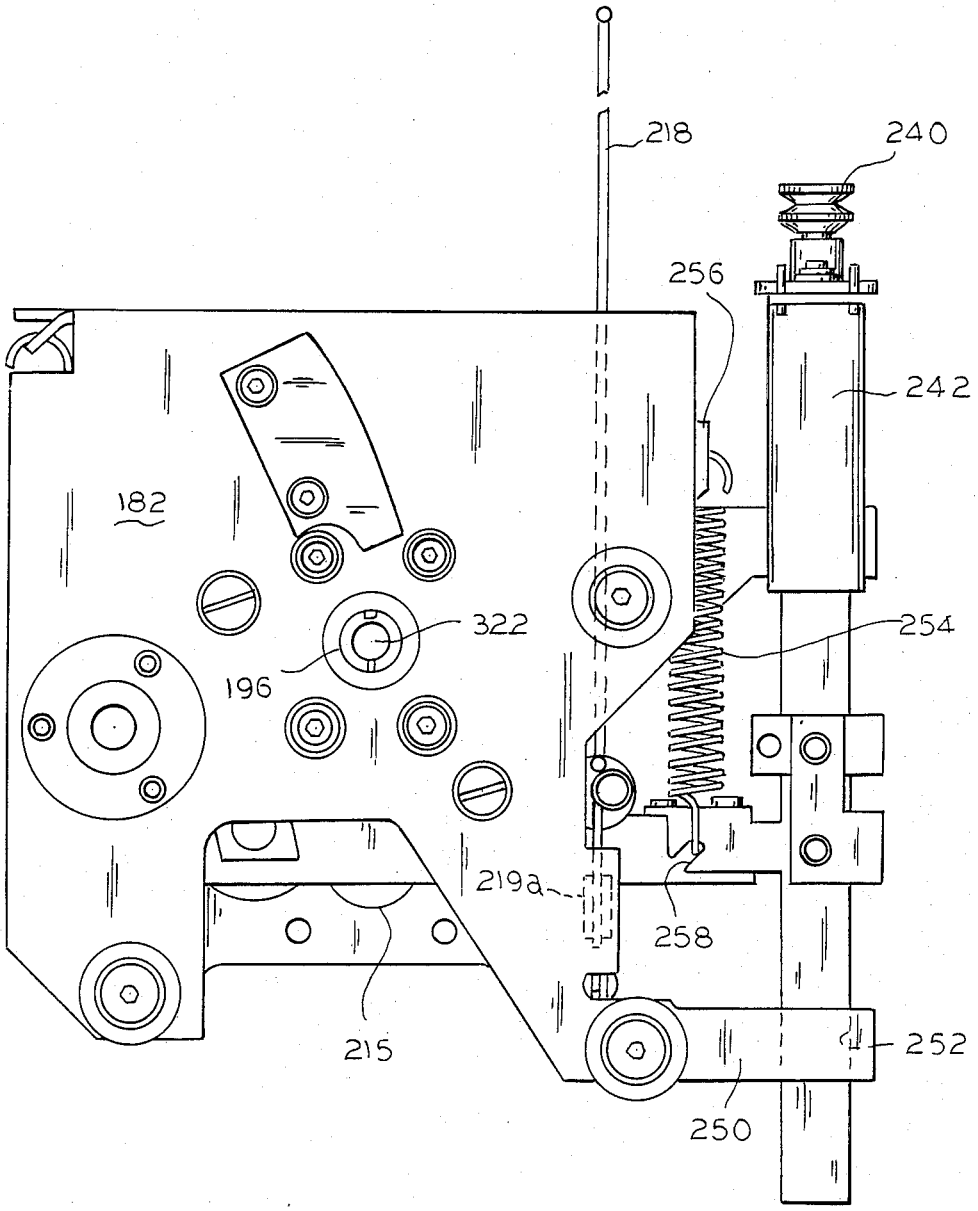
FIG. 17 is an elevational view in partial section of the hanging frame assembly as viewed on the side opposite from FIG. 13.
Figure 18:
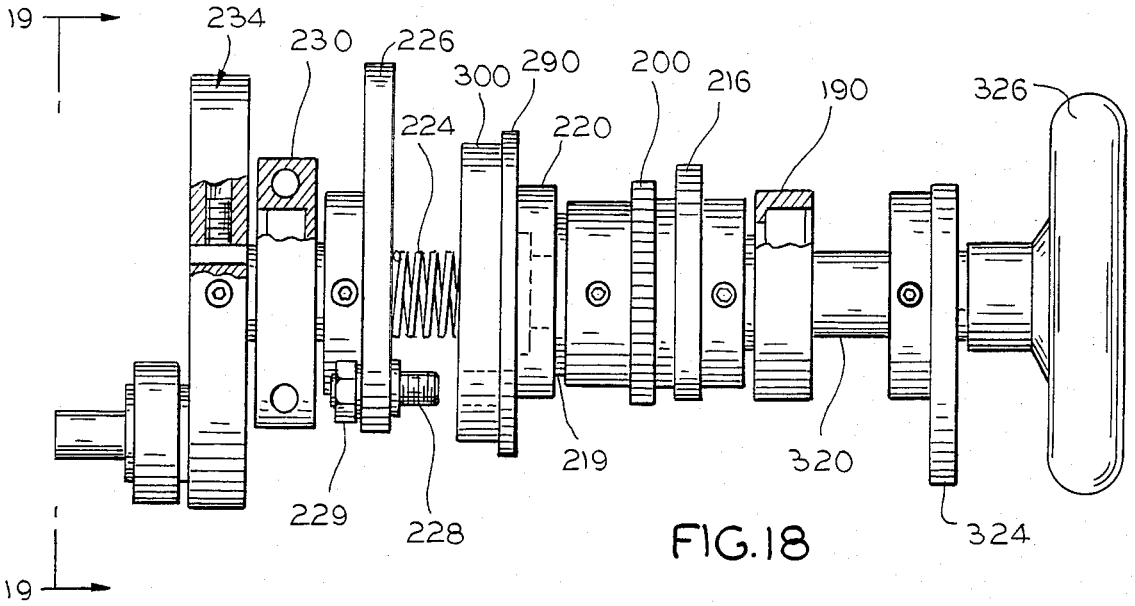
FIG. 18 is an expanded elevational view of the cam shaft assembly.
Figure 19:
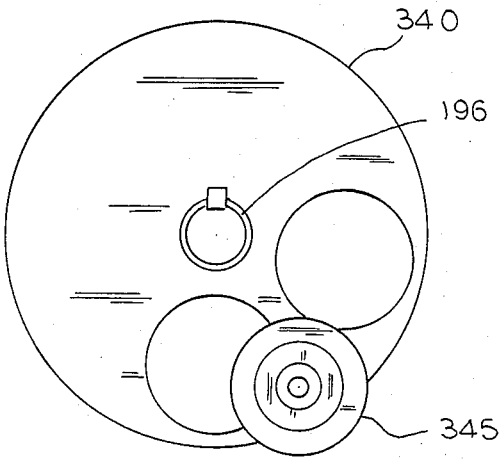
FIG. 19 is an end view taken along line 19—19 of FIG. 18.
Figure 21:
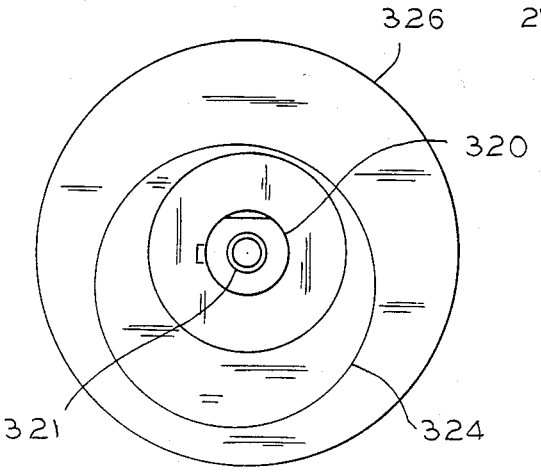
FIG. 21 is an end elevational view as taken along line 21—21 of FIG. 20.
Figure 20:
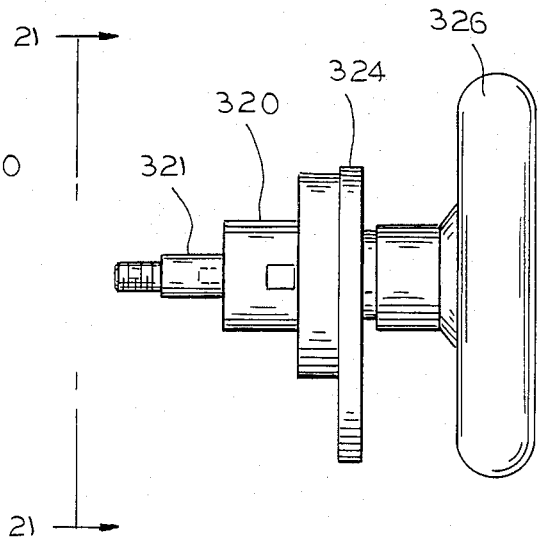
FIG. 20 is an elevational side view of the cam shaft extension and a control knob.

Referring now to FIG. 18 for clarity, it is felt best to reiterate the disposition of the various parts on the cam shaft 196. At the right hand end there is a bearing block 190, normally supported adjacent wall 182, which then is followed to the left (as seen in FIG. 18) by the head lift cam 216, the power sprocket 200, a thrust washer 219, and then the valve body 220 with its orifice plate 290 and the valve rotor 300. The thrust washer 219 permits rotation of sprocket 200 against force of spring 224 which axially urges the non-rotating valve body 220 in the direction of sprocket 200 through the rotor 300 and aperture plate 290. Rotor 300 is spring loaded by spring 224 and driven by the circumferentially slotted elevator feeder cam 226 and its associated drive pin 228. The pin 228 is circumferentially adjustable, as by nut 229, so as to precisely adjust the timing of the rotor 300 relative to the shaft 196. The next item on cam shaft 196 is a main shaft bearing block assembly 230 which is an integral and supportive part of the centrally disposed major support 188. The cam shaft subassembly 234 will be discussed in detail hereinafter. It should be noted, however, that a subassembly that is not shown in FIG. 12 is the camshaft extension assembly (FIGS. 18, 20, and 21) that would extend to the right of right hand plate 182 in FIG. 12 and which includes a shoulder bolted shaft extension 320 with the shoulder bolt 321, not shown in FIG. 18, extending into the end of the cam shaft 196 (generally at the position shown as bore 322 in FIG. 17). As seen in FIG. 20, extending outwardly from the shaft extension 320 is a head draw cam 324 and a hand wheel 326.

The head draw cam 324 acts against a head draw lever subassembly 328 which is shown in FIGS. 18A and 18B. This subassembly 328 includes an angularly disposed pair of arms 329, 331 having a pivot point 330 at one extremity, a cam follower 332 at the midpoint, and a laterally spaced sheave 334 at the end of the angularly disposed arm 331. The action of this device will be more clearly apparent when a secondary structure will be discussed hereinafter.

Referring once again to FIG. 12 (right side), attention is directed to the control cable 218 which extends downwardly from the cam follower 212 to which the cable is attached, and then passes over a sheave **219*a*, extends across the distance between opposite edges of the hanging assembly to a second sheave 219*b*, and then extends angularly upwardly outside the side wall 182 to a third sheave 219*c***. The function and usage of this movement will be described hereinafter.

Figure 15A:
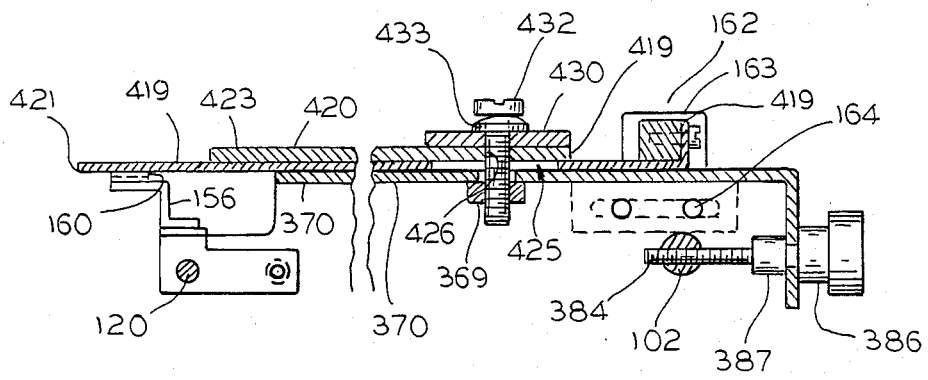
FIG. 15A is an enlarged detail in partial section of the support plate, breaker plate, platen and support, adjustment, and fastening means.
Figure 15:
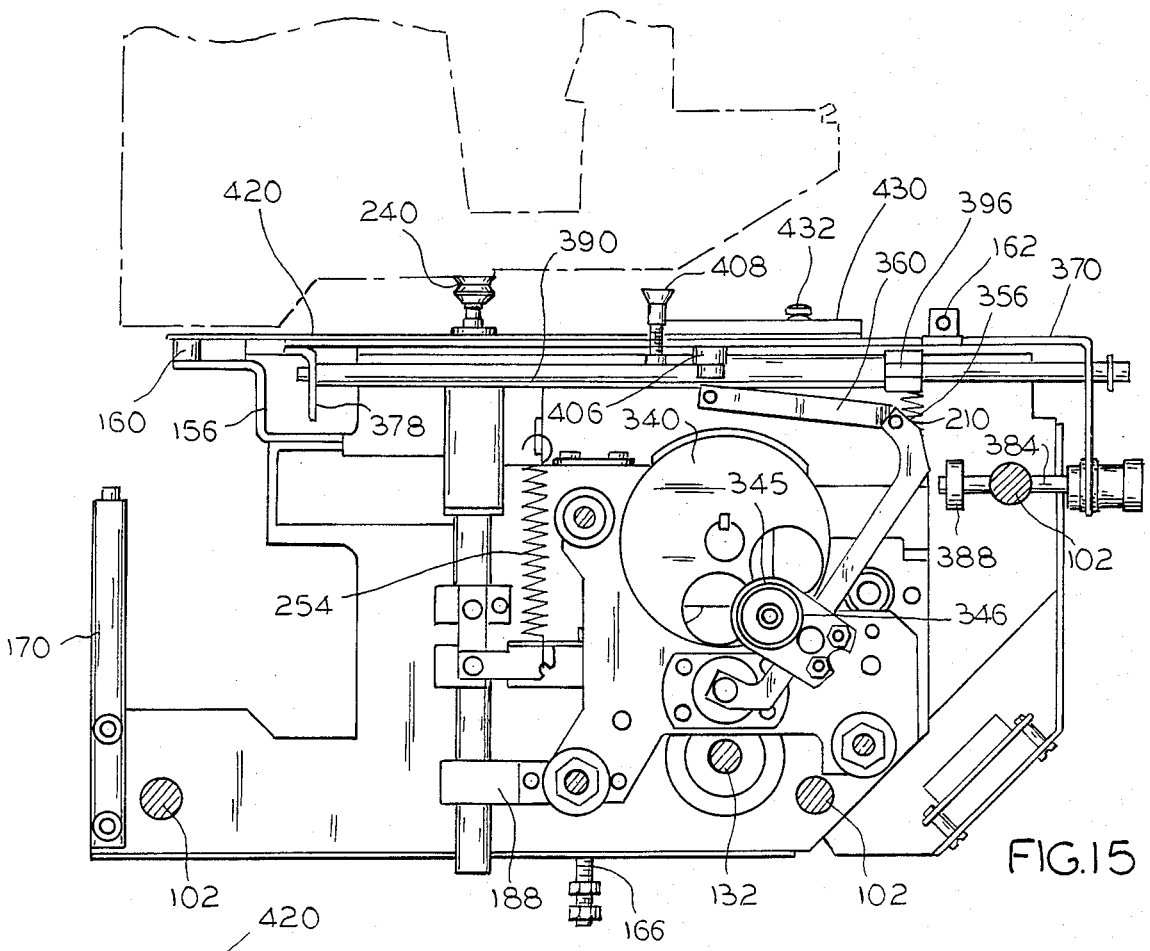
FIG. 15 is an elevational view in partial section as taken along line 15—15 of FIG. 4 showing the upper frame and hopper assembly in phantom.

Referring now to FIGS. 13 and 15, the cam shaft subassembly 234 includes a counterbalanced member 340 which is generally of a cylindrical configuration having portions thereof removed as at 342 to provide a larger disposition of weight on the opposite side of the axis. This rotating counterweighted device 340 carries suitable bearing means which is in the form of a rocker cage assembly 346 that surrounds the surface of a rocker arm 348. Rocker arm 348 is pivoted at one hooked end to a pivotal bearing 350 which is in turn attached to a fixed plate 351. The rocker arm and rotating counterweighted member 340 forms a modified oscillating-beam mechanism connected to the power source, namely cam shaft 196, by a suitable key means 352. The crank or rocker arm 348, at its end opposite the pivotal bearing 350, includes a outwardly extending arm 354 having at the extremity thereof a pivot pin 356. Referring now to FIG. 15, it will be seen that pivot pin 356 is connected to a bell crank 360 which through the action of the counter-weighted disc 340 and its corresponding cage 346 results in a lateral reciprocating motion for the bell crank 360. The purpose of this reciprocating motion by bell crank 360 will be explained herein-below.

Figure 33A:
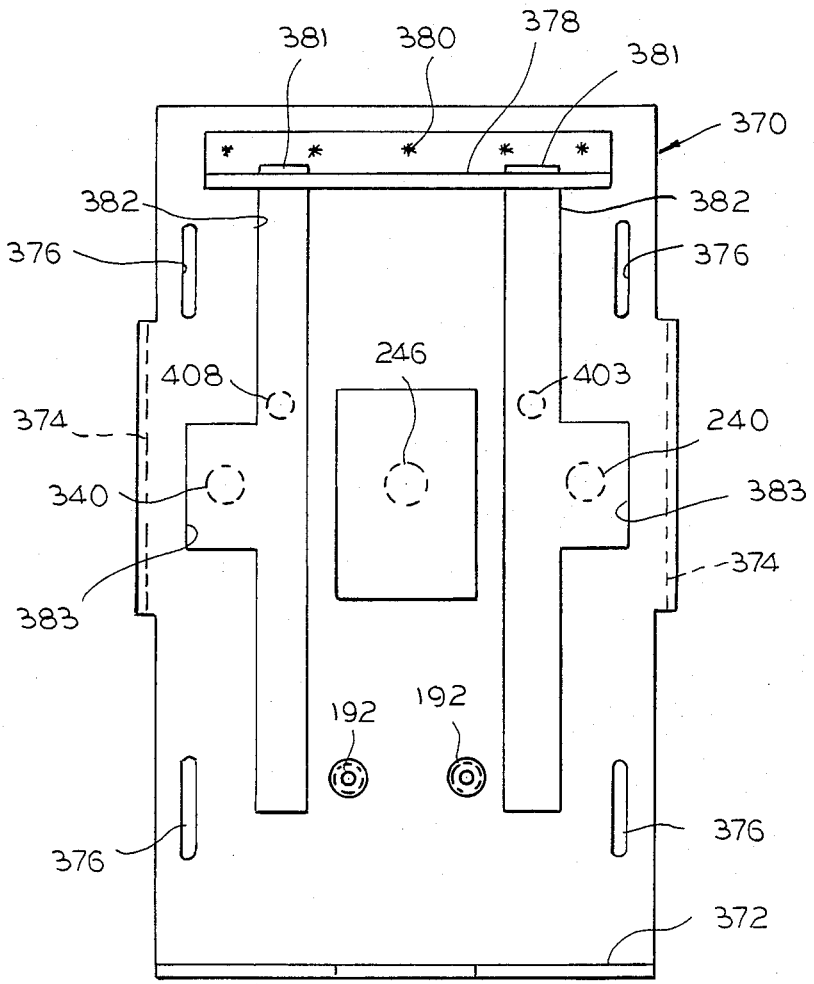
FIG. 33A is a plan view of a top support plate used in association with the platen and breaker plate shown in FIGS. 32 and 33.
Figure 27:
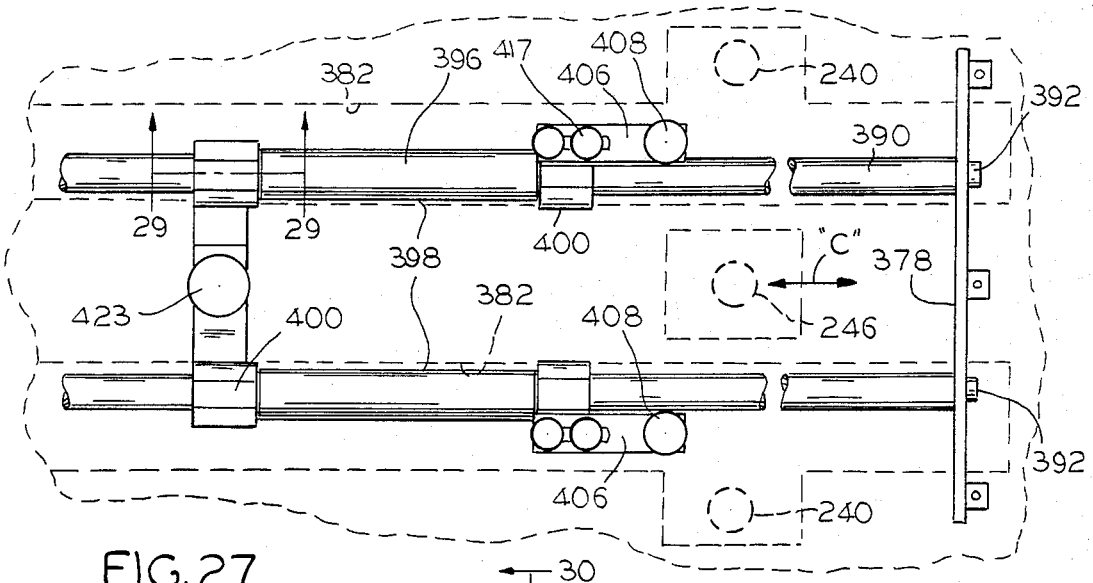
FIG. 27 is a partial underside plan view of the pusher pin carriage assembly mounted on the partial underside phantom view of a breaker plate.
Figure 33:
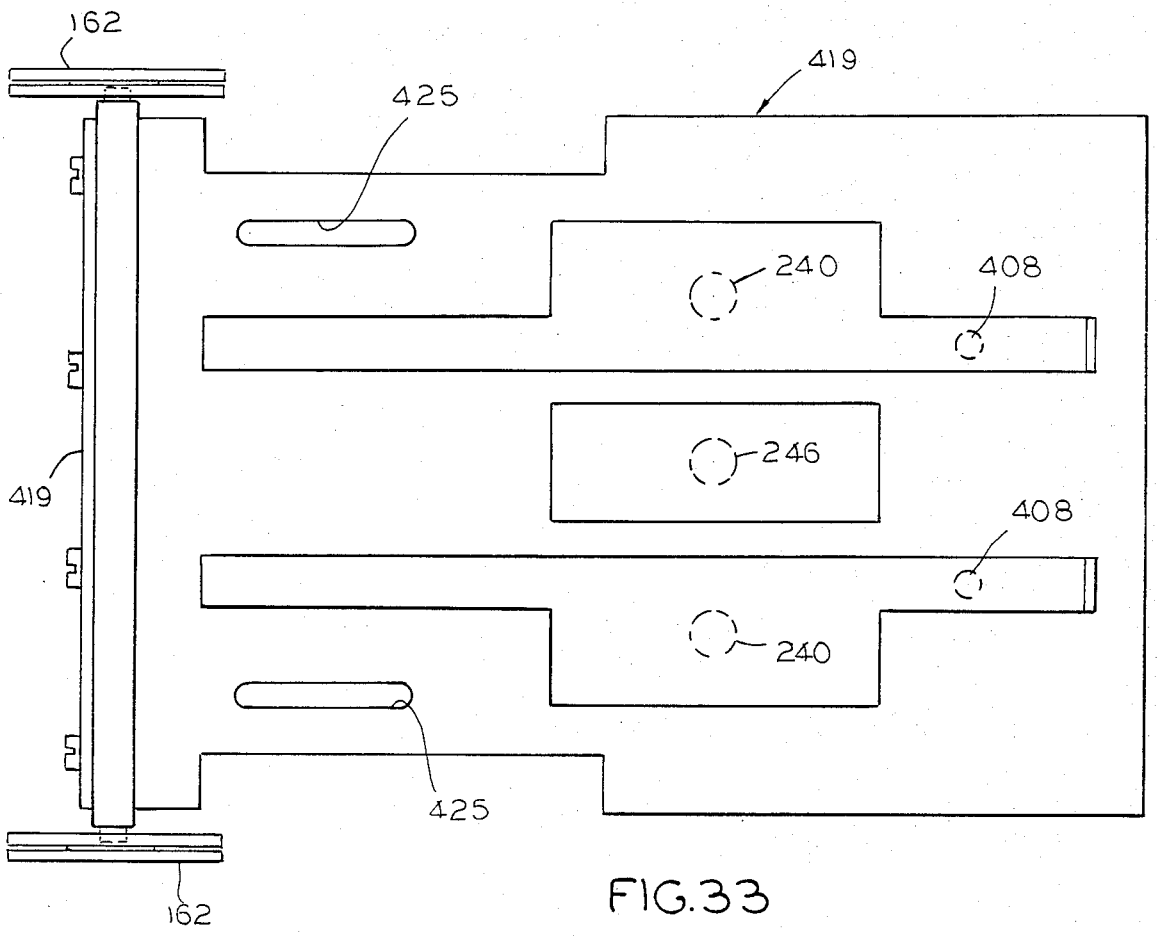
FIG. 33 is a plan view of a breaker plate used in association with a platen of the type shown in FIG. 32.

Referring now to FIGS. 15, 27 and 33, the upper extremity of the fixed frame is covered by a slotted cover plate or top support plate 370. The top support plate 370 includes a plurality of longitudinally extending slot means 382 (FIG. 33A) as well as a centrally disposed short enlarged slot means 383 communicating with slot 382, to accommodate the vertical movement of the bellows suckers 240, and the horizontal movement of pusher pins 408 described hereinafter. For clarity in illustration the bottom plan surface of the top support plate 370 is shown in FIG. 33a, wherein plate 370 at one end thereof includes a downwardly extending flange 372 and along opposite sides thereof a pair of upwardly extending generally triangular shaped flanges 374, shown in phantom from this bottom view, the flanges 374 being better seen in FIG. 3 where they serve as the pivot support for the upper housing. Top support plate 370 also includes two pairs of longitudinal adjustment slots 376. Adjacent the end of plate 370 opposite the downwardly extending flange 372 is a supporting frame 378 attached by suitable flange and fastener means, such as spot welding 380, and having a pair of apertures 381 intermediate and spaced to align with the longitudinally extending slots 382. As can be best seen in FIG. 15, the downwardly depending flange 372 includes a central aperture near its lower extremity adapted to accept a bolt 384 having an adjustment knob 386. The bolt 384 engages a threaded hole in tie rod 102 and is provided with a stop collar 388 at its extremity. A second collar 387 rotatively captures the extended flange 372 to the bolt 384 between collar 387 and knob 386 so that the top support plate 70 is moved laterally with respect to the fixed frame 90 when adjustment knob 386 is turned. This adjustment is required to accommodate a range of envelope heights so as to present the leading edge 82a of envelope 82 to the take away gripper of the inserting machine 60 in a relatively constant position, regardless of envelope height. This can best be seen in FIG. 3.

The top support plate 370 (see FIG. 5A) is mounted to the fixed frame 90 by suitable spring loaded screws 91 which locate the top plate 70 by passing through adjustment clearance slots 376 and engaging threaded nuts 101 in flanges 100 of end plates 92 and 94. A plastic washer 375 made from a suitable low friction, high wear material is disposed between the spring masher 91a and slots 376 in top support plate 370 for smooth adjustment.

A breaker plate 419 and platen 420 are positioned atop the top support plate 370. It is the purpose of the breaker plate 419 to provide an edge 421 (see FIG. 3) over which each envelope 82 is bent as it is positioned for extraction by the inserter mechanism 60. The location of edge 421 is not affected by adjustment of the top support plate 370 as described above to accommodate various envelope heights. The breaker plate is fastened to the fixed frame 90 through a square section transverse rod 163 which engages upwardly protruding tabs 162. The transverse rod 163 is suitably fastened to a right angle bend in breaker plate 419. Tabs 162 are adjustably fastened to fixed frame 90 by adjusting screws 164. The platen 420 is supported on anvils 160 adjacent end 421. Breaker plate 419 is provided with parallel elongated slots similar to those in top support plate 370 to permit vertical movement of bellows suckers 240 and horizontal movement of pusher pins 408. Slots 376 in the breaker plate permit adjustment of the top support plate 370 (and platen 420 to be described hereinafter) with respect to the fixed frame 90 without affecting the locations of the breaker plate 41 (and its edge 421) with respect to the fixed frame. The method of retaining the breaker plate through these slots will be described hereinafter.

Figure 31:
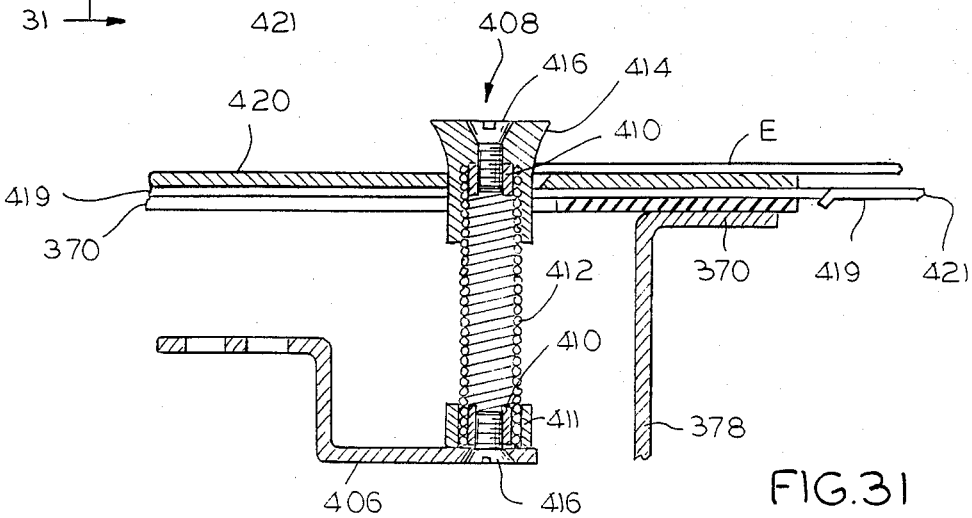
FIG. 31 is a vertical sectional view of the pusher pin taken along line 31—31 of FIG. 30.
Figure 32:
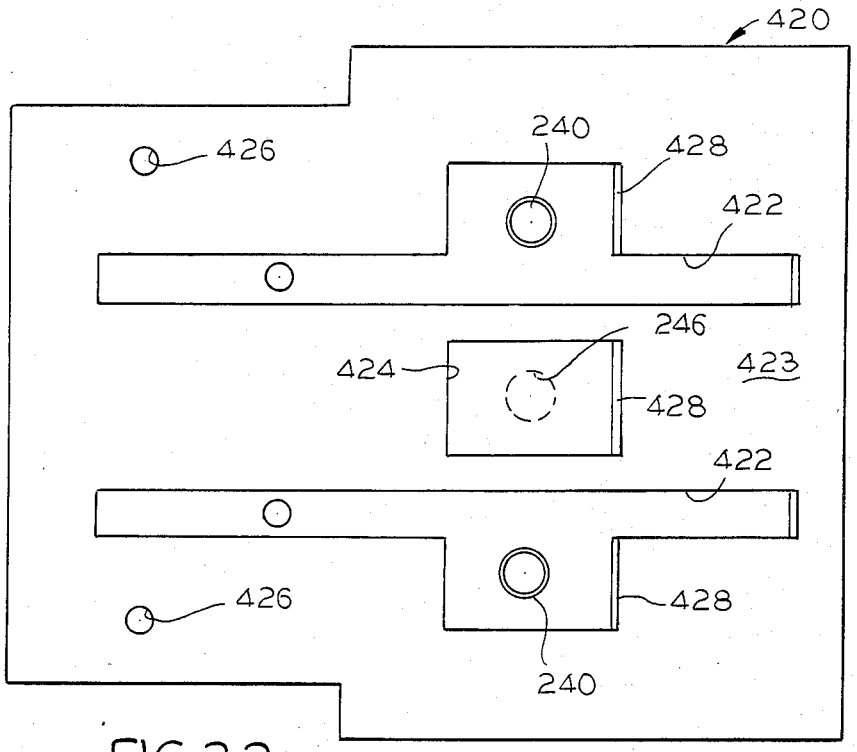
FIG. 32 is a plan view of a platen utilized with the present invention.

A platen 420 is positioned atop breaker plate 419, effectively "sandwiching" breaker plate 419 between platen 420 and top support plate 370 (see FIG. 31). Platen 420 is also provided with parallel elongated slots 422, similar to those in top support plate 370, to provide clearance for the vertical movement of bellows suckers 240 and horizontal movement of pusher pins 408. A plan view of platen 420 is shown in FIG. 32. In this embodiment it was found best to provide chamfered edges 428 at the ends of all slots of the platen to prevent the envelopes 82, which slide across the top surface of platen 420, from engaging or stumbling on the end of the slots. An area or section 423 of platen 420 is positioned with respect to the top support plate 370 to provide a backup surface, or anvil, against which the impact printer works, as will be described hereinafter.

Platen 420 is held in a fixed relation with respect to top support plate 370 for this purpose. A platen retainer 430 is positioned atop the platen 420 at the end of the platen opposite section 423. As can best be seen in FIG. 15a, the sandwich of platen retainer 430, platen 420, breaker plate 419, and top support plate 370 is held together by the force of spring washers 433. Suitable fastener, such as machine screws 432 pass through the spring washers 433, clearance holes 426 in platen retainer 430 and platen 420, clearance slots 425 in breaker plate 419 and engage threaded nuts 369 that are fixed to the top support plate 370.

Thus, adjustment of top support plate 370 with platen 420 and printing means described hereinafter can be made with respect to the fixed frame 90 and inserter means 60 without affecting adjustment of breaker plate 419 and its edge 421. This adjustment is necessary to accommodate envelopes of various heights. Likewise, breaker plate 419 and its edge 421 can be adjusted with respect to the fixed frame 90 and inserter means 60 without affecting adjustment of the top support plate 370 and its printing means. Thus, adjustment can be made, where necessary, to accommodate various weights or stiffness of envelopes being fed.

As can best be seen in FIG. 16, the adjustment of top support plate 370 and its printing means with respect to fixed frame 90 causes relative movement, as indicated by arrows "A" and "B", between shaft 196, which is effectively located by top support plate 370, and shaft 132 which is effectively located by fixed frame 90.

The spring loaded take up idler 206 accommodates the small change in length of the path of drive chain 198 when the relative adjustment mentioned above is made. The chain drive 198 is designed to minimize the amount of timing change that occurs when the adjustment mentioned above is made any such timing change, if any, is well within the limits of timing deviation acceptable in the operation of a device of the type contemplated by this invention.

Figure 28:
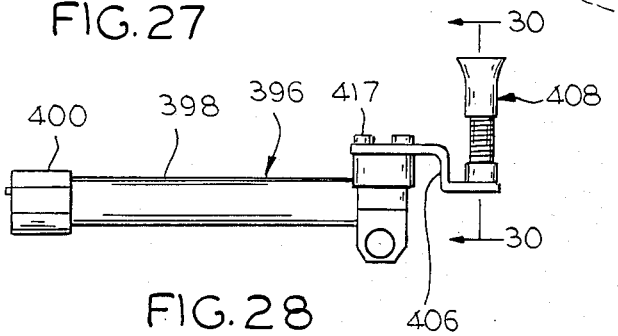
FIG. 28 is a side elevational view of the pusher pin carriage assembly.
Figure 29:
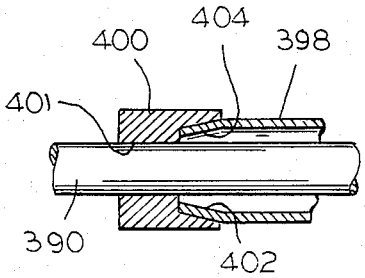
FIG. 29 is a partial sectional view taken along line 29—29 of FIG. 27 of the bearing and tubular assembly of the pusher pin carriage.
Figure 30:
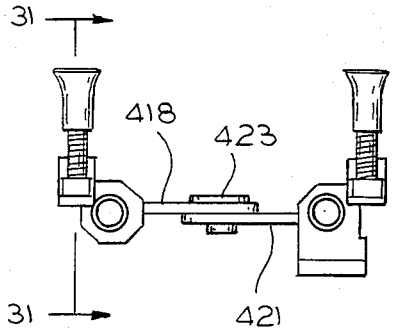
FIG. 30 is an end elevational view taken generally from the right hand end of the carriage as seen in FIG. 27.

Referring now to FIGS. 27-31 as well as FIG. 15, the top support plate 370 supports a pair of rigid bars or rods 390 which extend through apertures in the flange 372 and are supported by suitable screw means 392 at the opposite ends of the bars 390 with the screw means 392 at the left end in FIG. 15 engaging threaded holes in the depending flange 378 of the support means. The bars 390 are spaced apart a predetermined distance so as to be generally parallel to and underlie the slots 382. The bar rods 390 support and permit travel of the transport mechanism consisting of a carriage assembly 396 slidably mounted on the bars 390 and carrying a pair of pusher pins 408 by means of brackets 406 (FIG. 28).

In previous devices, it was discovered that the bell crank 360 and its heavy frame counterpart-type of mechanism produced extremely high acceleration as it moved a carriage assembly forward and back, and therefore it was desirable to reduce the mass of the transport mechanism in order to reduce the resultant forces developed. The present device overcomes this problem. The carriage 396 consists of a pair of lightweight metallic tubular members 398 that are each supported at opposite ends by a bearing nut-like ferrule member 400. Each of the elements 400 has a tapered counterbore 402 (FIG. 29) with the end of the tubular members 398 being constricted as at 404 to provide a tight mating fit with the tapered counterbore 402. This tapered effect provides a positive locking means which can, if necessary, be enhanced by suitable adhesive or fastening means (not shown). The tubular members 398 are preferably made of an extremely lightweight rigid metal such as aluminum or magnesium. Additionally, the interior of each bearing or guide ferrule 400 is treated with Teflon® to form an impregnated hard anodized aluminum, thereby providing a lightweight rigid ferrule that accepts the tapered soft aluminum tubing 398.

Supported on two of the ferrules 400 by a bracket 406 is an upright standing pusher pin 408. The pusher pin 408, as can be best seen in section in FIG. 31, includes a tight wound extension spring 412 with threaded tubular nut members 410 pressed into opposite open ends. Nut members 410 are slightly longer in diameter than the inside diameter of spring 412 to cause a tight, permanent fit between the spring 412 and nut members 410. Spring 412 is preferably wound with pre-tension. The spring 412 is fastened to bracket 406 with suitable fastening means such as screw 416.

Before assembly with screw 416, a collar 411 having an inside diameter smaller than the outside diameter of spring 412, when assembled with nut member 410, is force fitted over the base of spring 412 in the vicinity of nut member 410. When nut 410 and collar 411, which capture spring 412, are brought into abutting relation to bracket 406, by draw-down action of screw 416, the assembly is positively secured in a substantially perpendicular relation to bracket 406. At the opposite end of the spring 412 the bugle shaped cap 414 is mounted, cap 414 is flared at one end and counterbored at the opposite end to cooperatively accept the spring and tubular nut pre-assembly in the same force fit manner accomplished by collar 411, previously described. The cap also includes a central countersunk aperture communicating with its counterbore and adapted to accept a screw 416 complimentarily accepted in nut 410 for positive retention of cap 414 relative to spring 412.

The bracket 406 is adjustably supported on associated ferrules 400 by fastening means 417 that operate within a slot 407 in the brackets 406. The opposite end of the carriage 396 includes a self-adjusting pair of arms 418 and 421 (FIG. 30) that are interconnected by a fastener means 423 which permits the ferrules 400 to adjust to any irregularities of the carrying rods 390. The rods 390, may not be exactly parallel and hence the self-adjusting feature found in the fastener 422 and its associated arms permits the carriage to maintain a stable progress in opposite directions, as indicated by the arrow "C" in FIG. 27.

The function and purpose of transporter mechanism 396 is as follows: when the bellows suckers 240 bring an envelope "E" down to the upper surface of the plate-like device 370 (FIG. 15) and release the document, the pusher pins 408 then move the document horizontally into position from the stack or source over to a location beneath the printing mechanism with which it is associated. .The relationship of the cap 414 to an envelope E is shown with reference to a work surface such as the platen 420 in schematic form in FIG. 31.

Positioned atop the breaker plate 419 and support plate 370 is a polished platen 420, as seen in FIGS. 15, 15A, 31 and 32. The platen 420 includes parallel elongated slots 422 extending in the longitudinal direction of the platen and having a central aperture 424 as well. The position of platen 420 is retained and is laterally adjustable by means of platen retainer 430, suitable fastening means 432 extending through the apertures 426 and the elongated adjustment slots 425 of the breaker plate 419 into nut elements 369 captured in top support plate 370. While the rear end of the platen 420 is held down by a platen retainer 430 with spring washers 433 acting against fastener means 432, the opposite end of the platen 420 rests on breaker plate 419 and anvil pads 160. While it is not mandatory that the platen 420 be polished, it is suggested that tapered edges 428 (FIG. 32) be provided wherever a document sliding on its upper surface might hang up or be prevented from smooth passage over that surface.

Thus, the lower fixed and hanging frame assemblies described above provide a mechanism for sequential movement of documents by the bellow suckers 240, with a timed source of vacuum being supplied through the novel valve mechanism 220. Upon release of the document from the suckers onto the work surface or platen 420 by release of negative pressure when ambient pressure is introduced, the transport mechanism in the form of the pusher pins 408 advances the document or envelope to a proper position 423 under the printing mechanism. The balance of this specification is primarily directed to the upper frame structure which supports the hopper or stack of supply documents, a supporting means for the printing mechanism module, and means for elevating the printing mechanism so as to permit free passage of envelope 82 under the printing mechanism prior to printing, as well as providing additional means for rocking the printing mechanism from the work surface to correct or remove jams should they occur. Further, a power source is provided for the mechanical movement of the print head across the face of the document or envelope. These have been generally discussed heretofore but the specifics will be enumerated as the description of the upper frame progresses.

Figure 3:
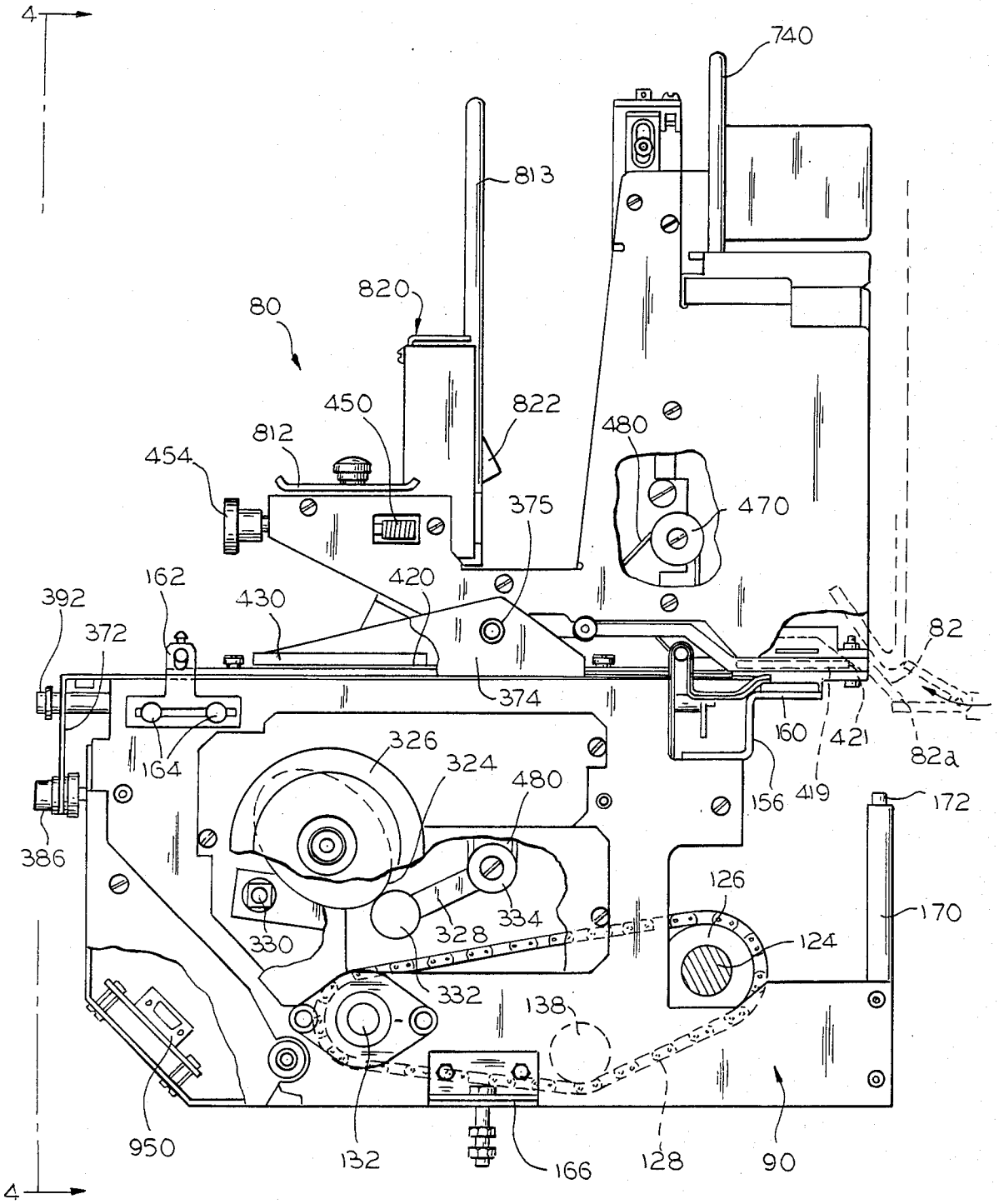
FIG. 3 is a side elevational view in partial section of the improved printing apparatus of the present invention showing the connection of the operating elements of the printing apparatus with the main power supply derived from the insertion machine with which the printing apparatus is associated.
Figure 40:
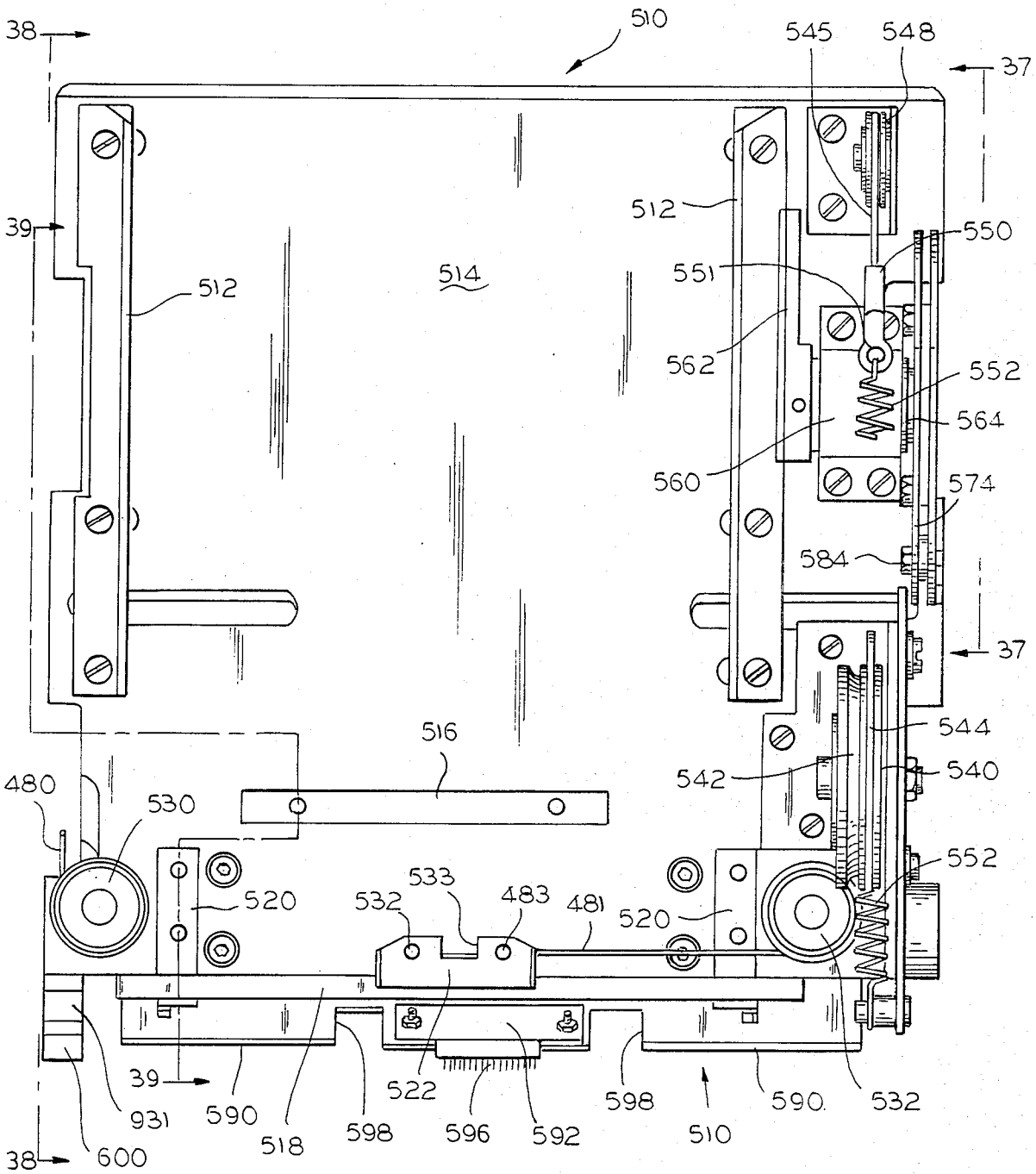
FIG. 40 is a partial elevational view of the divider plate assembly.
Figure 41:
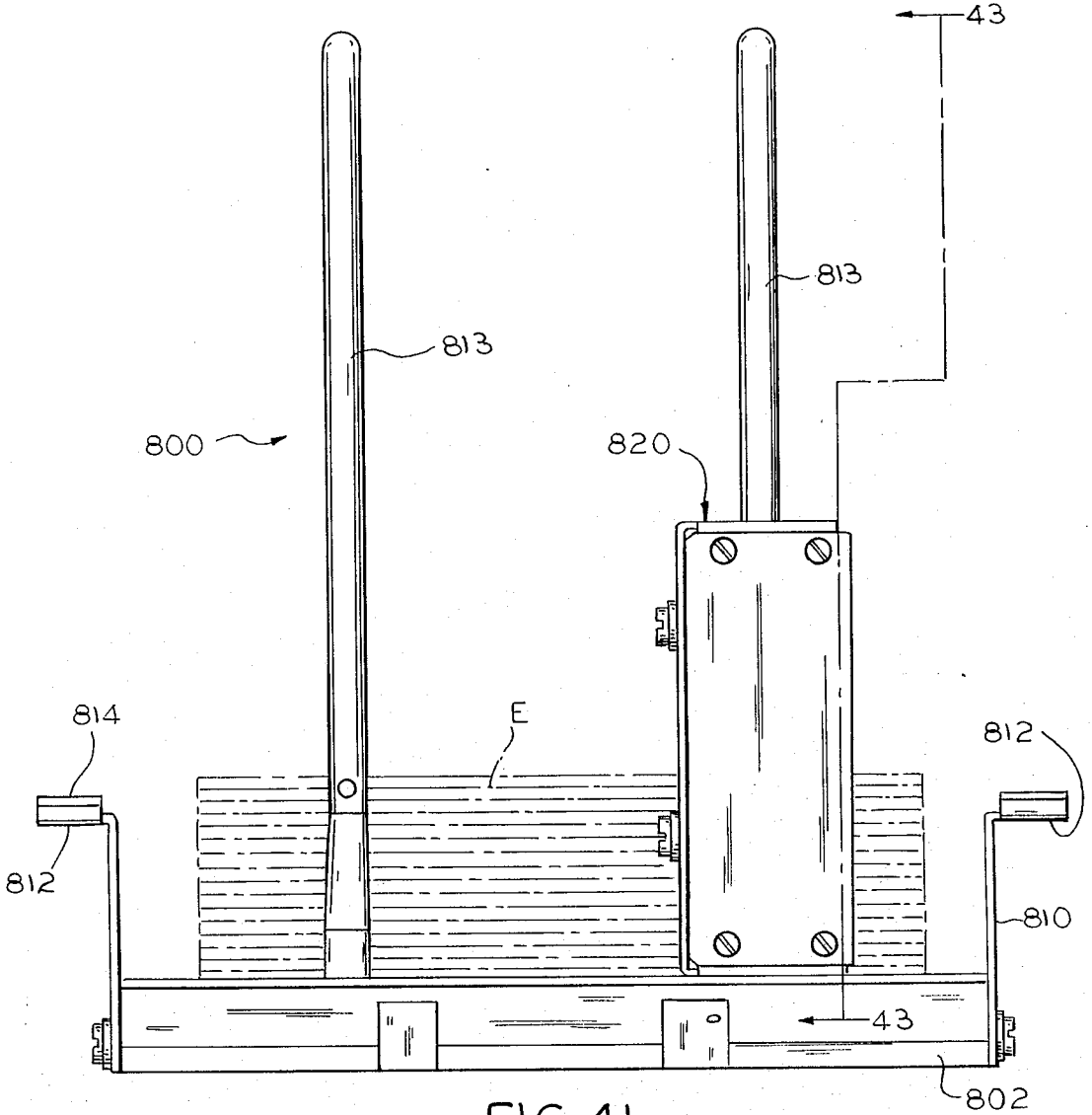
FIG. 41 is a rear elevational view of the document hopper.
Figure 44:
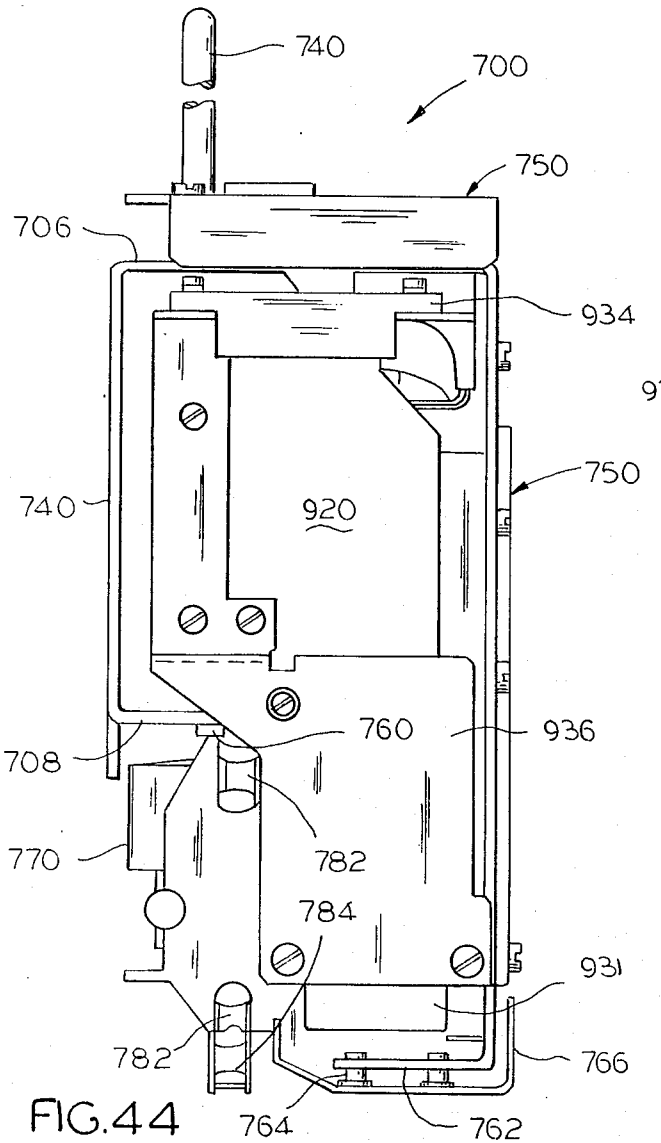
FIG. 44 is a side elevational view of the print module assembly which includes the U-frame fixed assembly and the U-frame floating assembly.

The upper frame generally includes four major modules which are interconnected and supported on pivot 375 on the upright triangular portions 374, previously mentioned (FIG. 3). The upper housing includes a left and right hand hopper assembly 440 and 490 respectively, (FIGS. 34, 36), interconnected and separated by a central or divider plate assembly 510 (FIG. 40). Positioned between and adjacent the right and left hand hopper assemblies 440 and 490, respectively, is the rear support ledge assembly 800 (FIG. 41). The printing module assembly 700 (FIGS. 44 and 45), which is removable, is carried by the divider plate assembly 510 and positioned between portions of the right and left hand hopper assemblies 440, 490 from whence it receives certain power takeoffs. (Module assembly 700 is not shown mounted on rear support ledge assembly 800 in FIG. 41 for clarity in illustration.)

Figure 35:
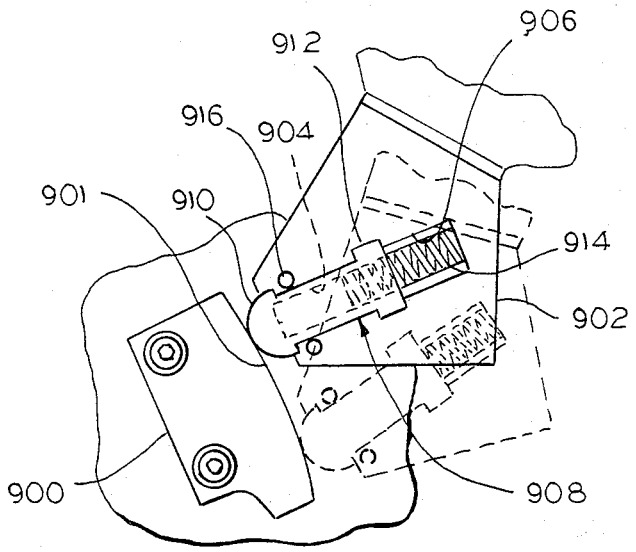
FIG. 35 is a partial assembly view of the over center counter-balance cam mechanism.
Figure 34:
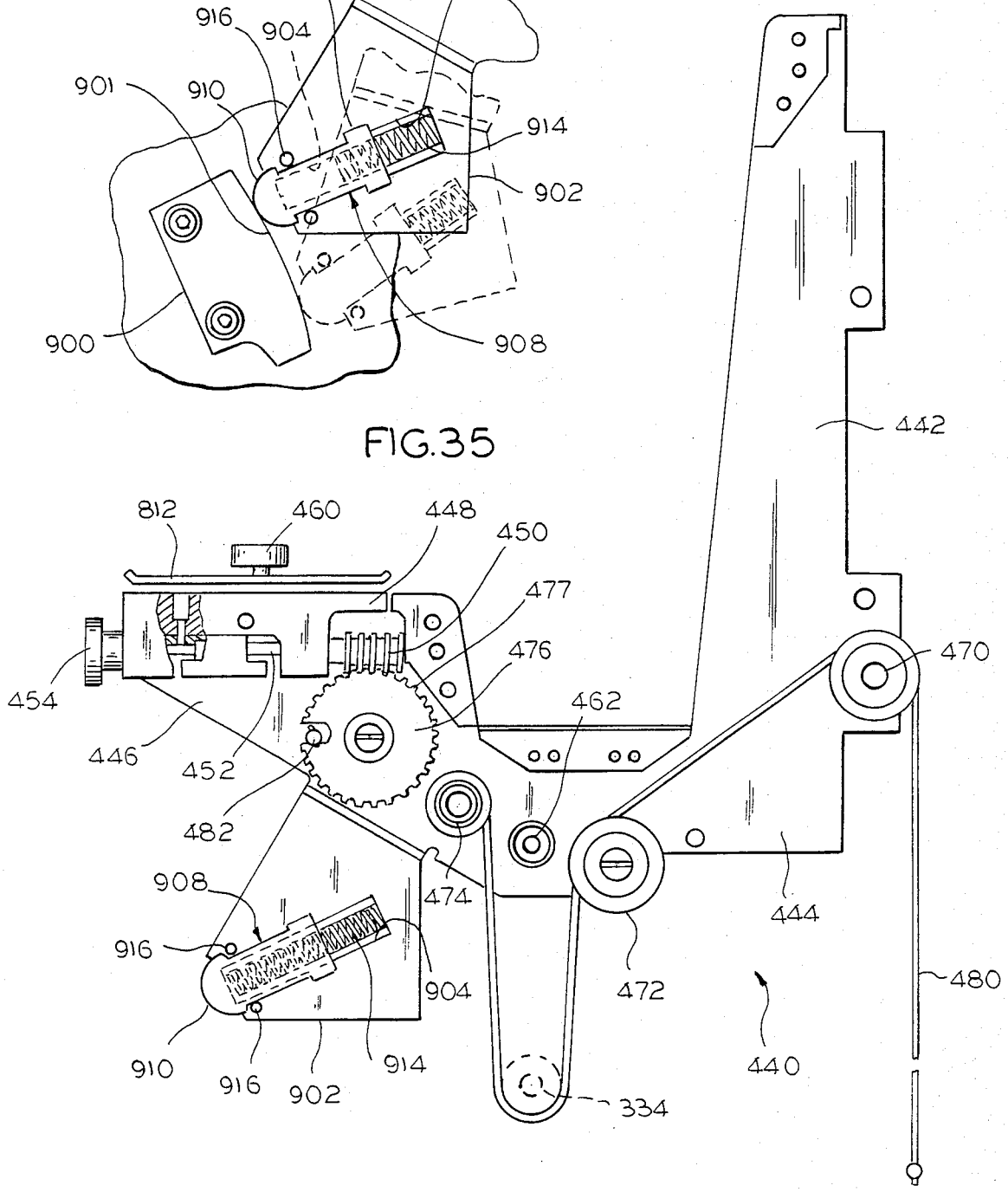
FIG. 34 is an elevational view in partial section of the inside of the left hand subassembly of the hopper assembly.
Figure 36:
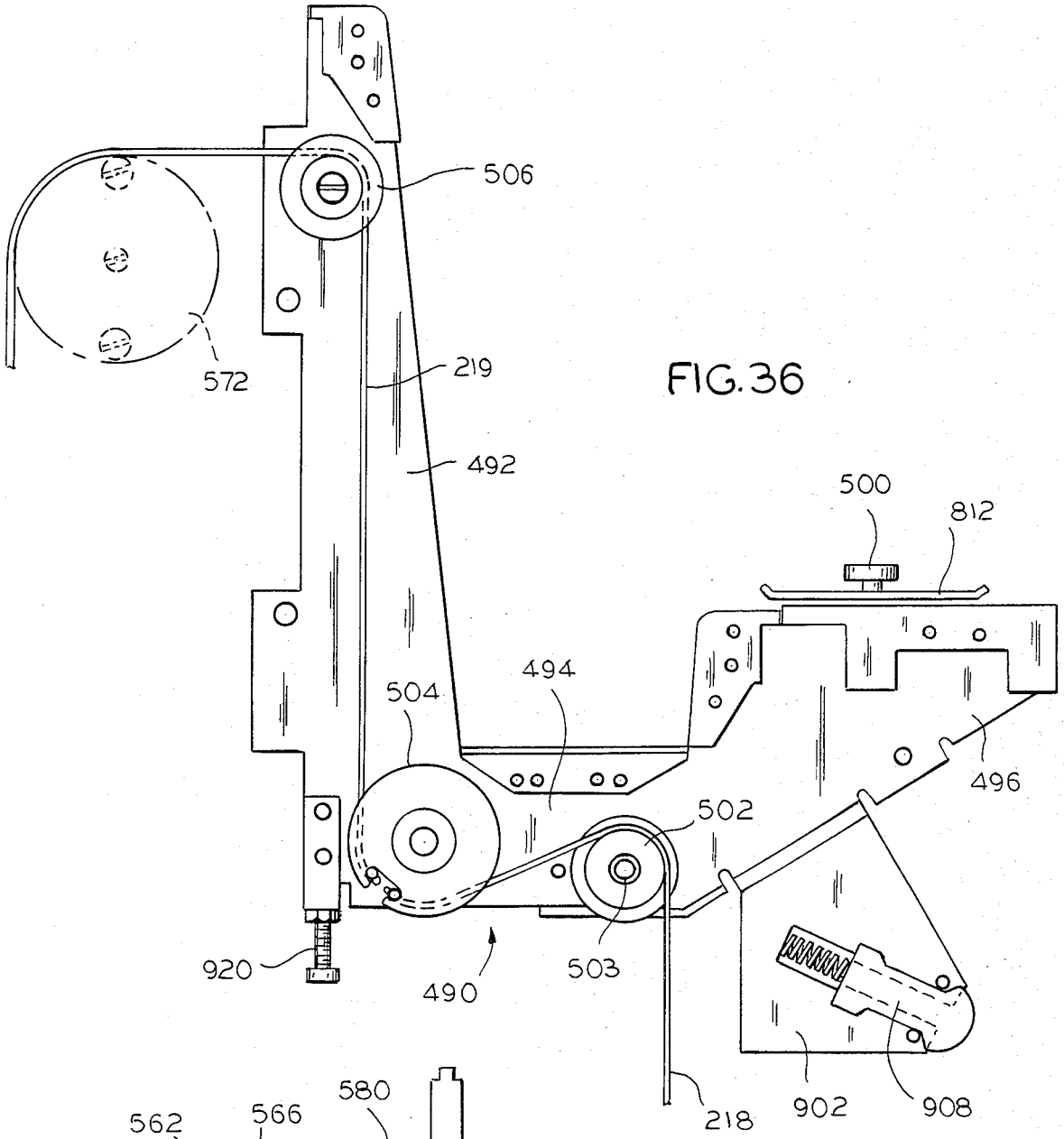
FIG. 36 is an elevational view in partial section of the inside of the right hand subassembly of the hopper assembly.

Referring now to FIGS. 34–40, it should be noted that the right and left hand hopper subassemblies shown in detail in FIGS. 34 and 36 are actually the inside surfaces of these elements, and not what is normally seen when the machine is in operation. They are in a "denuded" state without any of the normal aesthetic housing materials. Both the right and left hand hopper assemblies 440 and 490 are generally J-shaped members having an elongated arm extending generally perpendicular from the base and a stylized short arm that extends angularly from said base.

The left hand hopper assembly 440 (FIG. 34) includes a J-shaped sheet metal body having an upwardly extending elongated leg 442, a generally flat base 444, and an angularly disposed short arm 446 terminating in a generally flat upper angularly projecting bracket 448 which accepts and houses an adjusting worm 450 with its connecting drive shaft 452 and adjusting knob 454. Atop the bracket 448 is an adjustable clamping means 460, the purpose of which will be set forth hereinafter. The J-shaped body generally has a centrally located pivot 462 that is interconnected to the main frame pivot 375 (FIG. 3), for purposes set forth hereinafter. Mounted to the short arm 446, central base 444 and the upward elongated arm 442 are a series of three pulleys, namely 470, 472 and 474, each of which is adapted to accept a control cable 480 with one terminal end 482 of said cable 480 being connected and attached to an additional pulley 476 that has a circumferential portion thereof in the form of a worm gear 477 for engaging the worm 450. By rotation of the knob 454, therefore, it is possible to shorten or elongate the control cable 480 through rotation of the geared pulley 476.

Movement of cable 480 is controlled by a moving pulley 33 (shown in phantom in FIG. 34) that is capable of moving in both directions within the depending loop between pulleys 472 and 474. By referring to FIG. 3 it can be seen in the lower cutaway that the head draw cam 324 acts on a follower 332 connected to draw lever 328 of the type shown in FIG. 18A, and results in the pulley 334 moving upwardly and downwardly as lever 328 pivots about pivot shaft 330, thereby causing the head draw control cable 480 to forshorten and move at its end opposite fixed end 482, for reasons to be better explained hereinafter.

Referring now to the right hand hopper assembly designated 490 (FIG. 36), it too has a generally stylized J-shaped configuration with an elongated upright arm 492, a generally flat central portion 494, and a short angularly disposed leg 496 generally terminating in a flat bracket 498 adapted to carry the clamp 500, similar to the clamp 460 on the opposite side. This subassembly includes three cable pulleys, namely 502 on the main body portion, 504 at the juncture of the body and the upright leg 492, and a pulley 506 at the upper end of leg 492. The sheave or pulley 502 accepts head lift control cable 218 which is connected at one end to the head lift sub-assembly 212. The movement of cable 218 occurs as a result of the head lift cam 216 (FIG. 18) acting on the cam follower 214 (FIG. 16) which pivots the assembly 212 about pivot point 215 to thereby produce a precise predetermined amount of travel in cable 218. The opposite end of cable 218 is connected to and terminates in the split pulley 504 (FIG. 36). Extension cable 219 extends upwardly from the split pulley 504 over the upper pulley 506 for purposes best set forth hereinafter.

The pivot point for the above-described hopper assembly is found along the axis of the pulley 502 designated by the numeral 503. A bearing block 501 provides support for the pivot point 503 on the exterior surface illustrated in FIG. 43. This is comparable to the opposite pivot point and will engage the triangular supporting member 374 (FIG. 3) on the opposite side of the machine to provide a suitable pivot which is coaxial with the pivot 462 (FIG. 34) on the opposite side.

Figure 39:
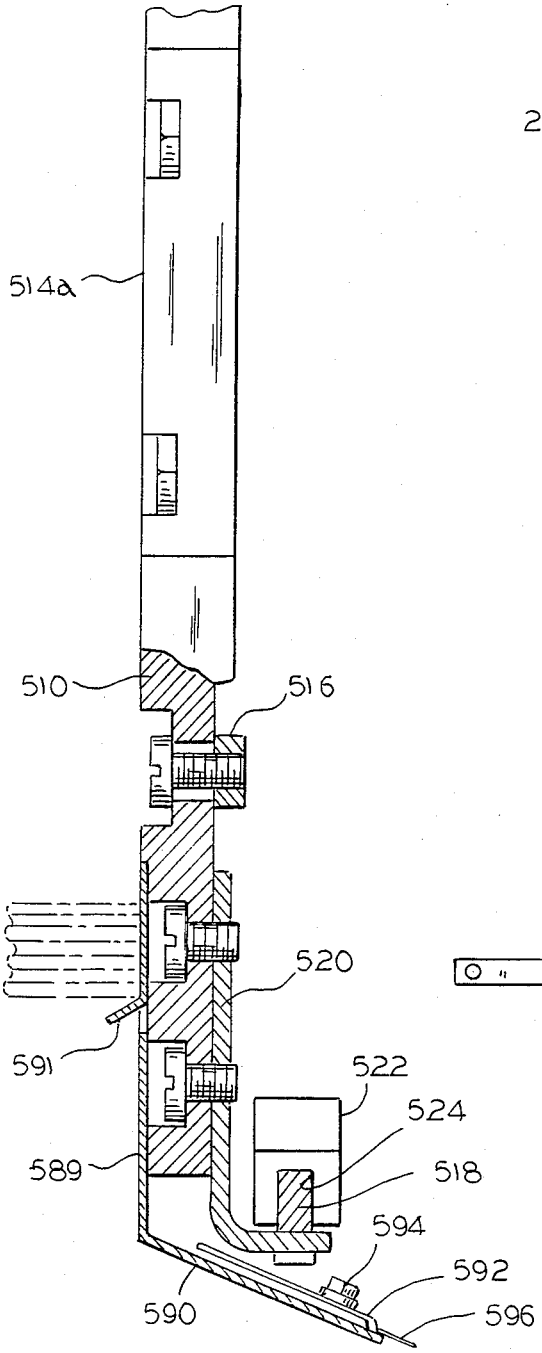
FIG. 39 is a partial end elevational view of the divider plate assembly taken along line 39—39 in FIG. 40.
Figure 38:
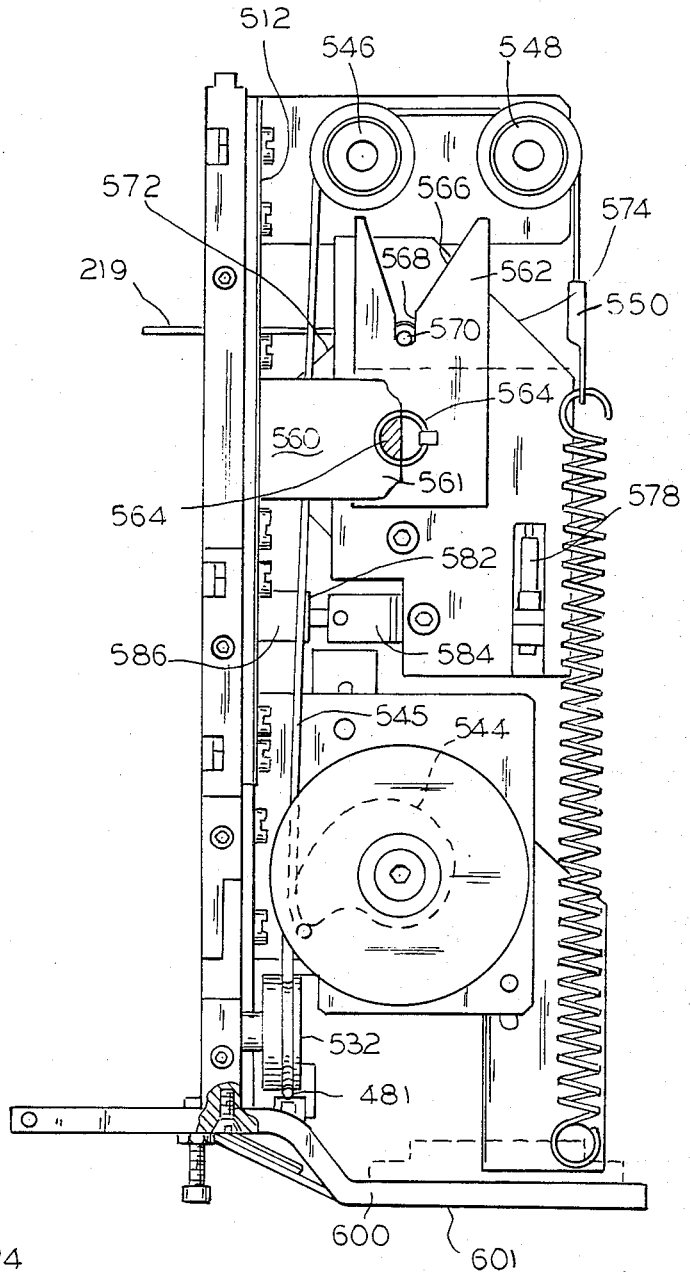
FIG. 38 is an end elevational view of the divider plate assembly taken along line 38—38 in FIG. 40.

The divider plate generally designated by the numeral 510 is best seen in FIG. 40 with partial side views shown in FIGS. 38-39. The divider plate 510 is the mechanism which ties together the actions of the two hopper support means 440, 490 and provides a support for the print module 700. The divider plate 510 is generally rectangular or square in configuration, is of a substantially rigid nature, and supports a plurality of operating mechanisms carried thereon. On its front face 514 it carries a pair of spaced parallel track members 512 which adjustably override the face 514. These tracks are utilized primarily for accepting and carrying the print module 700 in a piggyback arrangement. The stop shoulder 516 controls the lowest position of insertion of the print module 700. As can be seen, also mounted on the bottom of front face 514 is a transverse sliderail 518 supported by the right angled brackets 520 suitably fastened to the divider plate 510. The brackets 520 can be best seen in the partial enlarged view at the lower portion of FIG. 39 carrying the transverse slide rail 518. Mounted on the rail is the print head carriage draw slide 522 which is a generally block-like member that includes an elongated central slot 524 for compatably accepting the rail 518 for movement therealong. To provide movement of slide 522, there is a control wire 480 (FIG. 40) which extends around a first pulley 530 to one side of the slide 522 where it is terminated at 532 Pulley 530 is rotatably mounted to face 514. On the opposite side of the slide 522, a continuation control cable 481 is fastened at its termination 483 and progresses around a second pulley 532 rotatably mounted to face 514 at the right hand side of the divider plate 510. From that point, the control cable 481 extends upwardly and winds around a constant diameter portion 542 of the double pulley 540. The constant diameter portion 542 comprises a singular groove on enlarged pulley 540. The second groove 544 of pulley 540 has a varying depth, which can be best seen in phantom in FIG. 38. A third segment of cable 545 is connected to groove 544 at its greatest diameter, and then progresses upwardly over a pair of rotatable pulleys 546 and 548, and continuing thence downwardly to a termination connector 550 having an eye 551 that is connected to an extension spring 552 (FIGS. 38, 40). Since elongated extension springs, such as 552, inherently provide varying force, the varying diameter 544 of the pulley 540 eliminates this variance and produces a substantially uniform stress on the cable segment 481 as the sheave 334 (FIG. 34) moves the cables 480 and 481. Therefore, the cables 480 and 481 will maintain a substantially uniform stress on the head draw block 522, with its centrally disposed controlling slot 523, as block 522 moves back and forth. The slot 523 cooperates with the print head in the printing module to cause it to move across the face of the document or envelope that it is printing to thereby insure uniform distribution of and spacing between the lines in a bar code.

A more complete explanation of the function of the varying diameter sheave 544 can be found in the copending application Ser. No. 806,367 filed Dec. 9, 1985, and owned by assignee of the present invention.

Figure 37:
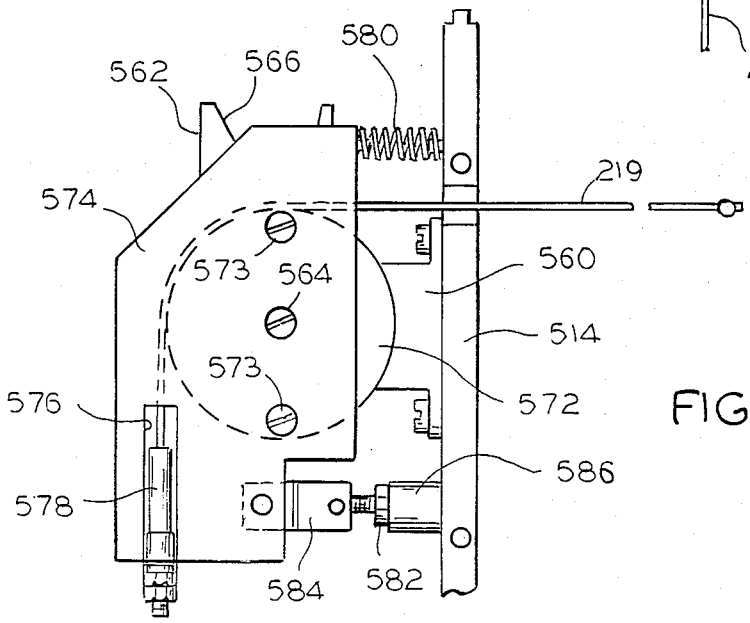
FIG. 37 is an elevational side view of the head lift cable termination mounted on the divider plate assembly and taken along line 37—37 in FIG. 40.

Positioned above the variable radius sheave 544 is another unique aspect of the present invention. It is well known that when a control cable such as cable 219 (FIGS. 36, 37) is fastened tightly at its extremity and the cable is then moved relative to that termination, a strong tendency for fracture occurs after extensive bending about the termination. In the present invention, the following structure was developed to eliminate that problem. Referring to FIGS. 37 and, 38, on the front face of the divider plate 514 is a bracket 560 which has a centrally disposed transverse bearing 561. The bracket 560 on one side of the bearing supports an arm 562 mounted on shaft 564 carried by bearing 561, and includes a V-shaped slot 566 terminating in a restricted neck 568 for capturing a pin-like element 570, for purposes set forth hereinafter. Attached to bracket 560 is a cylindrical member 572 that is sandwiched between two flat elongated plate portions 574, the lower end of plate portion 574 including a recess 576 adapted to accommodate an adjustable cable termination member 578. The plate-like members 574 are fastened to the cylindrical portion 572, as by screws 573, and adapted to rotate in a small arc as a unit about bearing 561 with the shaft 564 in fixed relation the cylindrical portion. Arcuate rotation of the cylindrical member 572 results in arcuate movement of the V-slotted member 562 mounted on the opposite end of shaft 564. As the cable 219 is wound around the cylinder 572 and pulled to the right, as seen in FIG. 37, the flat member 574 rotates clockwise about shaft 564 and acts at the upper end against spring 580 to maintain tension in the control cable 219. At the opposite end of member 574 an adjustable stop means 584 is mounted on adjustable stop as to bracket 586 fastened to the divider plate 514. In this fashion, as a force is placed on the control cable 219, it will carry out its directional change but because of the high radius of the cylindrical portion 572, cable 219 has a much longer life span. The function of the control cable or head lift cable 219 is to cause the rotation of the slotted member 562 through a small arcuate path, and to thereby elevate a portion of the print module away from the platen and breaker plate, thereby permitting movement of an envelope under and out from under the print mechanism. The double spring parallelogram construction contemplated for the elevation of the print mechanism is discussed below and is related to the print module construction found in U.S. Pat. No. 4,582,312 owned by the assignee of the present invention.

As can best be seen in FIG. 39, the divider plate assembly 514 also includes a downwardly extending flange means 590 that carries at its lower extremity a clamping mechanism 592 with suitable adjustment means 594 for permitting the introduction of a brush-like member 596 for slowing down and retaining envelopes or other documents passing under the brush-like member 596 as the envelope approaches the print head station on top of the platen 420. It will be noted, in FIG. 40, that the downwardly directed flange means 590 is interrupted at two places 598 to permit and accommodate the pusher pins 414 as they push an envelope under the printing head. At the left hand edge of the divider plate 514 there is provided a rigid S-shaped bar 600 (FIG. 38) which locates and supports the electrical connector 601 which carries power and signals to and from the removeable printing module means.

Figure 45:
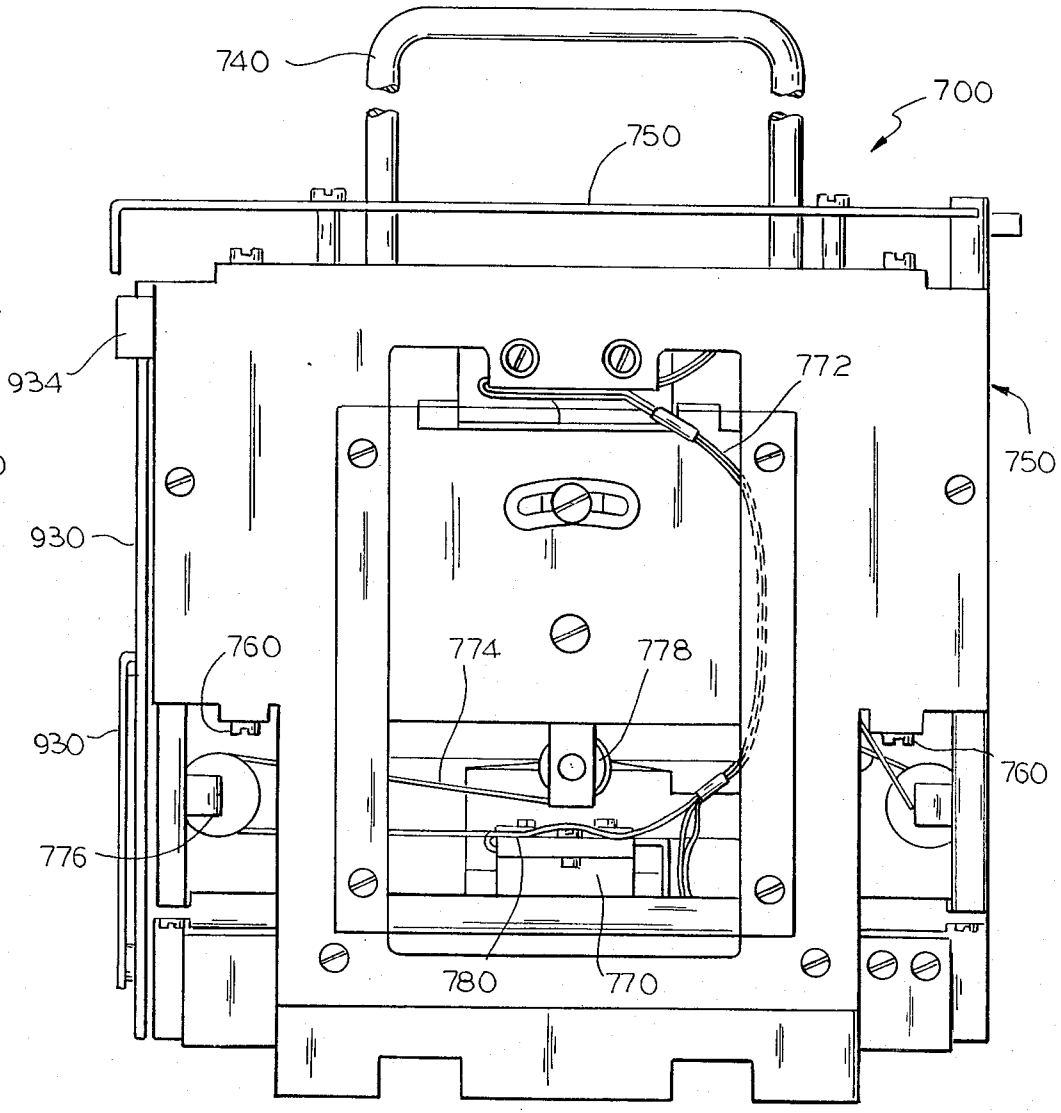
FIG. 45 is a front view of the print module assembly illustrated in FIG. 43.
Figure 47:
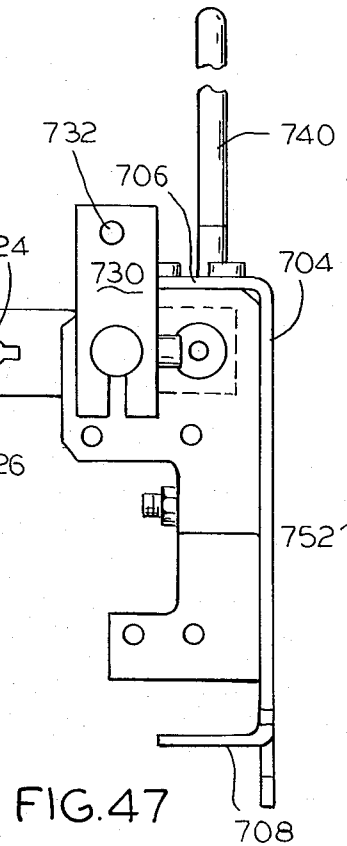
FIG. 47 is a side elevational view of the U-frame fixed sub-assembly.
Figure 46:
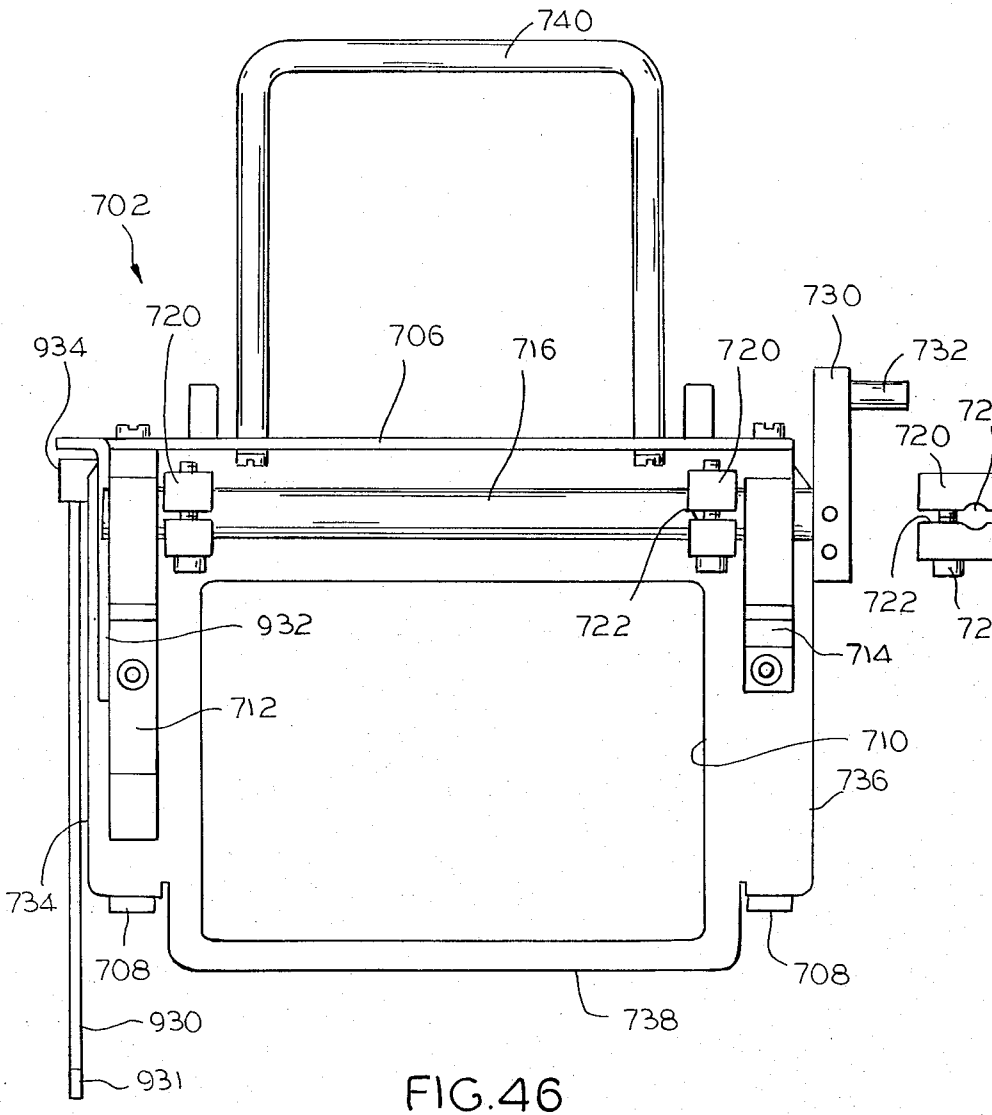
FIG. 46 is a front elevational view of the print module U-frame fixed sub-assembly.

Referring now to FIGS. 44–48, the print module 700 includes a U-framed fixed assembly specifically shown in FIGS. 46 and 47. This U-frame fixed assembly 702 includes a sheet metal back plate 704 having a top flange 706 and a pair of struck out and bent tabs 708 on opposite sides extending in the same direction as the flange 706. A large cutout aperture 710 removes a substantial portion of the metal in plate 704 for access to load and remove a print ribbon cartridge. Along each edge of this generally rectangular shaped frame is a fixed bearing lifter block 712 on one side, as seen in FIG. 46 and a shortened fixed bearing lifter block 714 on the opposite side. Extending between the two bearing blocks is a lifter shaft 716 supported at opposite ends in the bearing blocks 712 and 714. The lifter shaft 716 includes a pair of laterally extending rectangular lifter arms 720 being split at at least one end thereof, as at 722, to accept a cylindrical member intermediate its split extremities as at 724 (FIG. 47) and having locking screw threaded fastening means 726. The two identical lifter arms 720 are controlled by an operating lever 730 that is affixed to an outboard portion of the shaft 716 outside of the bearing block 714, and includes a laterally extending driver pin 732.

This U-frame fixed assembly utilizes its lateral edges 734 and 736 to be accepted under the inwardly directed members 512 that overlie the planar portion 514 of the separator plate (FIG. 40). The bottom edge 738 (FIG. 46) of this fixed assembly engages the stop means 516 (FIG. 40), while the handle 740 is utilized to move print module assembly 700 into and out of association with the divider plate assembly 514. A printed circuit board 930 is supported by bracket 932 which is suitably fastened to bearing block 712. The lower end 931 of the circuit board 930 engages connector 601 when the print module 700 is mounted in place on divider plate 514 and permits removal of print module 700, as well as disengagement of lower end 931 and connector 601 without need for special manipulation of end 931 and connector 601 by an operator. An axial force upwardly applied, as viewed in the drawing, to handle 740 permits easy removal. This is necessary from time to time to replace the ink ribbon cartridge. The upper end of the printed circuit board 930 engages another connector 934 which routes electrical signals to and from the printing head and its encoder to be described hereinafter. The print module assembly 700 (FIG. 45) also includes a floating assembly 750 that is supported by the fixed frame assembly. The floating assembly 750 includes structure which is supported and controlled by the operating lever 730 and its operating pin 732. For example, see FIG. 48 wherein the floating portion 750 is brought into overlying relationship with the fixed assembly 702. Additionally, the floating assembly 750 includes a back wall 752 having an inwardly directed flange 754 carrying an apertured block member 756 with a laterally extending dowel-type pin 758. Pin 758 extends through and is fixedly mounted to the lifter arm 720 by means of its adjustable aperture 724. At a lower position, the back wall 752 has a pair of struck out and bent tabs 753 on opposite sides and extending in the same direction as flange 754. These are connected to the inwardly directed flanges 708 of the fixed frame 702 by flexible spring members 757 which are suitably mounted by fasteners 755.

Figure 48:
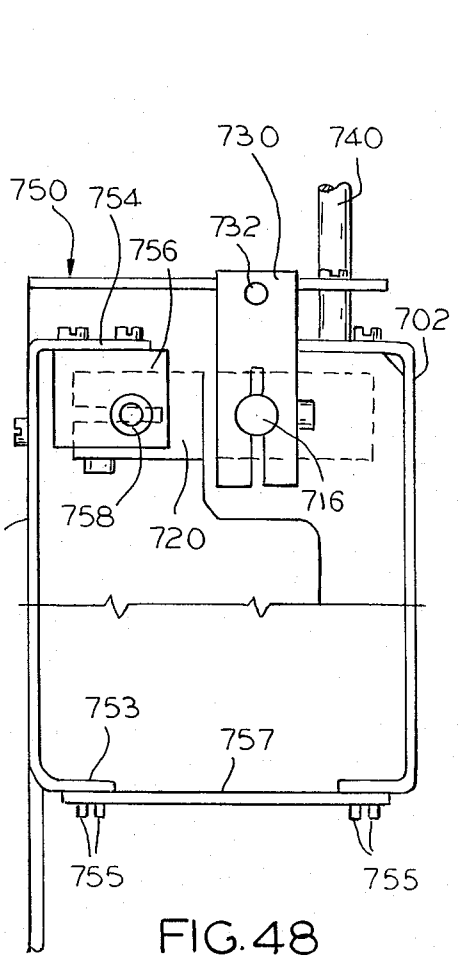
FIG. 48 is a partial view of the joining of the print module fixed u-frame sub-assembly and the floating U-frame sub-assembly.

When the control arm 730 is rotated about the shaft 716 in a clockwise direction, as seen in FIG. 48, frame 752 is lifted upwardly and will flex the spring member 757 as the floating unit 750 is raised. This produces an effect similar to the movement of a parallelogram, and essentially moves the floating unit 750 in a substantially linear path vertically away from the platen to permit removal of the envelope or other document from underneath the printing mechanism, after printing, and to permit introduction of a new document or envelope for subsequent printing. The floating assembly 750 at its lower extremity is supported by adjustable stop means 584 acting through plate like members 574, shaft 564, and arm 562. Back wall 752 has an inwardly directed flange 762 (FIG. 44), and has a pair of downwardly extending spring loaded stud members 764 which support a pressure plate 766. This pressure plate engages the envelope when floating assembly 756 is in its lowered position and assures the envelope being held in position against the platen during the printing operation.

The impact printing head 770 which comprises the printing mechanism of the present apparatus is mounted on a pair of tracks, not shown, and has the bottom extremity thereof on one side engaging the slot 523 in the print head carriage draw slide mechanism 522 that is moved back and forth by the control wires 480 and 481 when used in conjunction with the power source and the return spring 552, as best seen in FIG. 40. Electronic computer information is brought to the print head 770 by the cable harness assembly 772 through the connector EC, printed circuit roped PCB, and edge connector 934. A ribbon cassette and feeder mechanism are generally indicated in FIG. 45 by the travelling belt means 774 which operates around a series of idlers 776 as well as a one way clutch means 778 to maintain the ribbon feed in a single direction. The belt 774 is tied to the print head 770 by clamp 780, and by being clamped to the print head the belt 774 feeds the printing ribbon from the cartridge in a one-way direction under the print head 770 with a fresh strip of ribbon being incrementally provided for each printing action. The ribbon itself is fed over a series of rollers 782 and guide 784 (FIG. 44) with the guide 784 maintaining the ribbon in a semi-taut condition for action by the impact print head 770.

Figure 4:
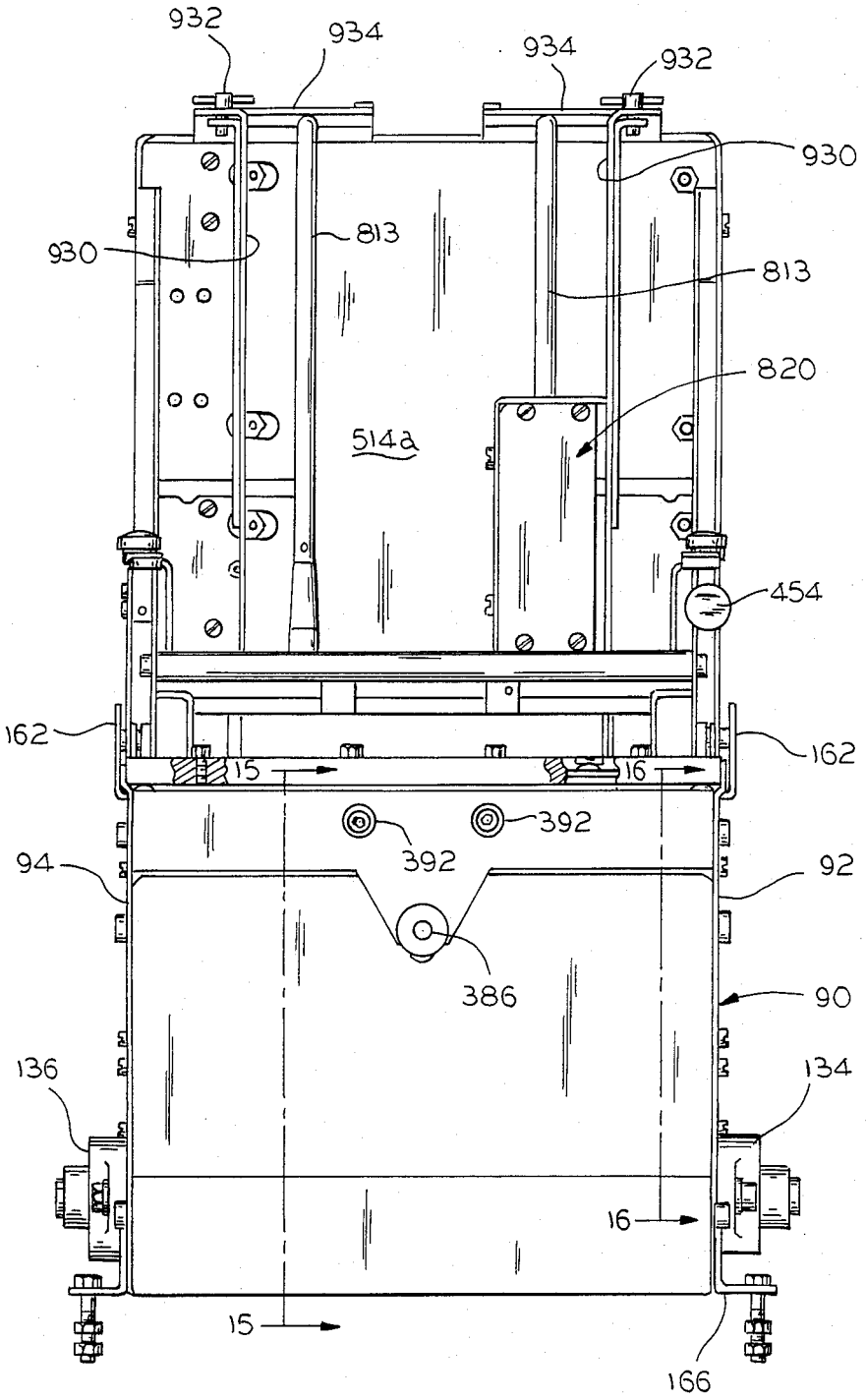
FIG. 4 is a rear elevational of the printing apparatus taken along line 4—4 of FIG. 3.
Figures 5, 5A:
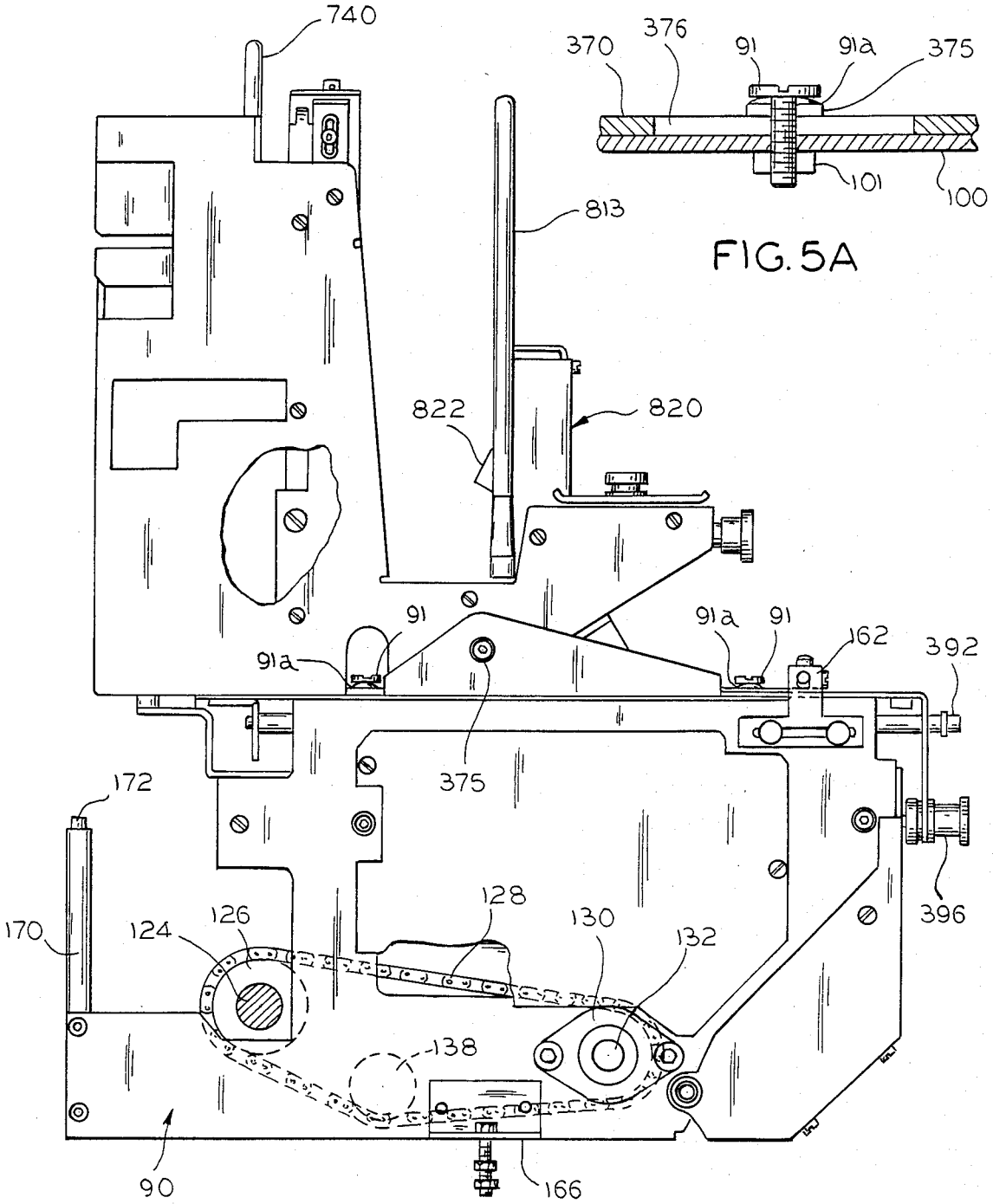
FIG. 5 is an elevational view in partial section of the printing apparatus as viewed from the side opposite from FIG. 3.
FIG. 5A is an enlarged detail of part of the top support plate, in section, and its fastening means attached to the lower fixed frame.
Figure 42:
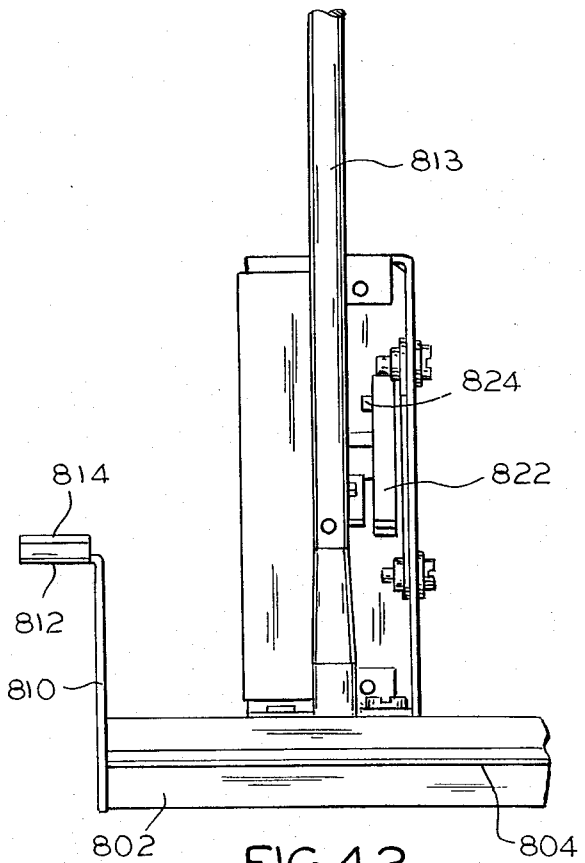
FIG. 42 is a partial elevational view of the front of the document hopper and exposing the means for alerting the operator as to the depletion of the document stack.
Figure 43:
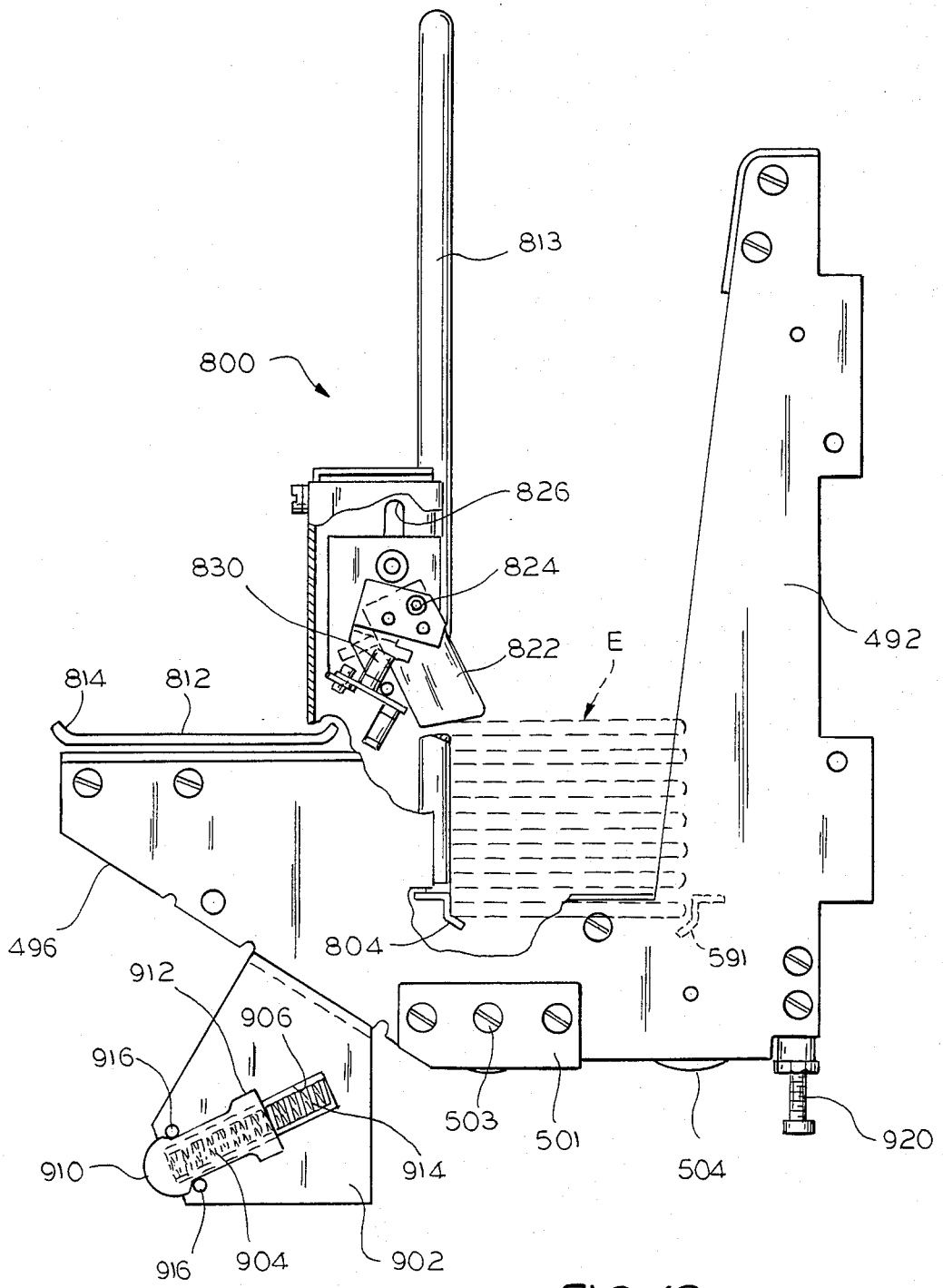
FIG. 43 is an outside end view in partial section of the left hand subassembly of the hopper assembly cut away to show the hopper with its document supporting ledge as well as to show in cutaway fashion the document low stack warning mechanism.

Spaced from the back surface 514*a* (FIG. 39) of the divider plate 510 main body, with references to FIGS. 41–43, is the rear support ledge assembly generally designated by the numeral 800 that is a necessary adjunct to the hopper aspect of this device. On surface 514*a* is a forward support ledge 591 (FIG. 39) that is appropriately fastened to the divider plate 510. Positioned in juxtaposed relation to surface 514*a* and in a laterally spaced vertical disposition are adjustable lateral guide means 930 controlled by fasteners 932 cooperating with slotted brackets 934, as best seen in FIG. 4. These guide means engage the opposite end edges of the documents or envelopes in the stack. They are adjustable to control lateral orientation of the stack within the limits of the slotted bracket 934.

Directly opposite back surface 514*a* and spaced therefrom is the rear support ledge assembly 800 as best seen in FIGS. 41–43. This subassembly includes a base portion consisting primarily of a flanged member 802 that carries a long downwardly inclined ledge or flange 804 that is in direct opposition to the ledge 591 (FIG. 39). The frame 802 is supported by a pair of brackets 810 positioned at opposite ends of the S-shaped flange 802 and having outwardly extending support means 812 that are flared upwardly at opposite ends 814 (FIGS. 41, 42). These outwardly extending support means 812 rest on the short arm upper edge of each of the hopper left and right hand subassemblies indicated as 448 and 498 (FIGS. 34, 36). The flanges 812 are longitudinally slotted to accept a retaining screw 460 and 500 (FIGS. 34, 36), respectively, on the two left and right hand assemblies, and thus permit the entire rear support ledge structure 804 to be adjustably moved toward and away from the back surface 514*a* of the divider plate 510. The device being thus adjustable will accept different heights of envelopes E in the stack (FIG. 41).

The side walls of the right and left hand hopper assembly serve as one portion of the hopper means, i.e. ultimate lateral retention, with guide means 930 being specific locating means, while the rear support ledge assembly 800 includes a pair of upwardly extending rod-like members 813 which provide an orientation for the opposite edge of the envelopes relative to the edge engaging the back surface 514*a* of the divider plate. Positioned on the back side of one of the locating rods 813, as shown in FIGS. 41–43, is a rectangular box-like structure 820 that houses a pendulum-type member 822 that is pivoted as at 824 and is vertically adjustable along its appropriate rod 813, as evidenced by the slot means 826 (FIG. 43). Pendulum-type member 822 is pivotal about pivot 824 and actuates a switching mechanism 830 when the supply of envelopes dimishes to a predetermined level, and thereby permits the counterbalance pendulum 822 to move to the right, as seen in FIG. 43, and thereby activate the switch means 830. This notifies the operator that the stack of envelopes is reaching a minimum level and that an additional supply must be inserted into the hopper to maintain continuous operation.

As was previously mentioned, one of the advantages of the presently disclosed device is that the entire hopper assembly, which is made up of the right and left hand hopper subassemblies 440, 490, the divider plate 514, and the rear support ledge assembly 800 with its warning mechanism 822, as well as the print module 700, can be rotated about pivots 375 in the side support means 374 (FIG. 3). When the device is moved counterclockwise about pivot 375, as viewed in FIG. 3, the cutaway or angled portions 446 and 496 (FIGS. 34, 36) in the hopper assembly side arms permits the device to move backwards about pivot 375 and thereby expose the entire platen surface under the printing head to eliminate jams, general cleaning, and for other emergency functions.

To aid and assist in this lifting operation, the device is provided with an over-center counterbalancing latch mechanism that assists in supporting the weight of the upper frame when it is tilted back. As can best be seen in FIGS. 34–36, and 43 curvilinear keepers 900 are mounted on opposite sides of the hanging assembly 180. Positioned on opposite sides of the right and left hand hopper subassemblies 440, 490 are a generally triangular shaped offset sheet metal portion 902 of the main frame of each subassembly. The portions 902 include an angularly disposed slot 904. Positioned within the slot 904 is a lubricious plastic side slotted latch follower 908 having a predetermined radius end 910 at one extremity and a head 912 at the opposite extremity. Latch follower 908 includes an open counterbore 906 at the end terminated by the head 912. Acting in counterbore 906 is a spring 914 that causes the lubricious outwardly directed plastic latch follower 908 to ride in a positive fashion over the curvilinear keeper surface 901 of the cam 900. The device includes a pair of pins 916 which are introduced after the device is slid on to the sheet metal slot 904. The pins 916 prevent the latch follower 908 from riding outwardly from the slot 904 prior to assembly. This structure results in a perfect loading operation by measuring the load on springs 914 in relationship to the pressure necessary to be expended against the keeper surface 901. When the latch follower 908 passes the midpoint or node like high over center portion of the keeper 900, the device, namely the retracted or tilted back hopper sections, will not move of their own accord without additional outside force being applied. This saves the delicate printing mechanism 770 from damage and insures that no positive harm takes place thereto. To insure limited return movement the side subassemblies 440 and 490 can be provided with a stop means such as stop 920 (FIG. 36).

Thus, there are a variety of features of this new improved printer which are unique and regarding which specific emphasis must be made. First, the present invention provides an integral adjustable timed valve mechanism 220 for controlling the vacuum by which envelopes are drawn by the sucker cups 240 out of the hopper by the sucker cups grabbing and causing the envelope to bend in the middle and to be drawn down both the ledge 591 on the back of the connector plate as well as on the rear support ledge 804. This bending creates a predetermined angularity in the envelopes whereby the two sheet metal ledges 591 and 804, which have a predetermined width and substantially the same predetermined angle, permit the envelopes to best be released from their supported position and permit the sucker cups 240 to readily move the bottom envelope down to the platen 370. The timing of the "turning on" of the vacuum is not as important as the "turning off" of the vacuum, when the shot of ambient air is bled into the system to permit the release of the vacuum by the bellow suckers 240 when the envelope reaches the platen and the suckers withdraw below the surface of the platen. The pusher pins 414 then move the device, namely the envelope, along the platen 370 into position under the printing head 770. The envelope is guided by the brush-like member 596 (FIG. 40) and held by the pressure plate 766 (FIG. 44), which holds the envelopes in position under the print module while the printing operation takes place.

While the timing of the valve is important, a secondary feature makes this design equally important, namely, the removability of the vacuum valve body 220. As will be recalled, the rotor 300, the orifice plate 290, and the vacuum body 220 are laterally spring loaded against one another through spring 224 (FIG. 12). By acting against the spring 224, it is possible to move the orifice plate 290 with its hub 293 axially out of the recess 263 in the vacuum valve body 220 (FIG. 26). Thereafter, the vacuum valve body 220 can be moved perpendicular to the shaft 196 through the slot 262 and be readily removed from the cam shaft assembly and rod 184 (FIG. 26). An air hose, a brush or a vacuum cleaner can be used to clean the rotor 300 and orifice plate 290, as well as to clean out the lines in the vacuum valve body 220. The orifice plate is keyed by pin 266 which is axially slidable, and the sliding seal between the rotor 300 and the orifice plate 290 provides a quick ready seal as well as permitting the aforesaid rapid dismounting. Similarly, the balance of the cam shaft can be quickly removed for servicing and cleaning by unscrewing the handle 326 in its attached shoulder bolt 321 (FIGS. 18, 20).

Referring again to FIG. 18, the pin 228 carried by elevator cam plate 226 is adjustable in a circumferentially disposed slot so that pin 228 can be quickly adjusted to change the timing of the rotor 300 and hence the timing of the application and release of negative pressure through suckers 240.

The construction of the presently disclosed device is lightweight, yet rigid, in that the spacer locater rods 102 (FIGS. 10, 11) are machined with the ends perpendicular to the rods' axis so that when the shoulder bolts 112 pull the ends of spacer locater rods 102 against the sheet metal frame, a rigid square frame is maintained.

The design of the envelope hopper formed by subassemblies 440, 490, and 800 is unique in that ready access is provided to the ends of each of the envelopes for gripping by the operator when installing the envelopes in the hopper, as well as providing a plurality of quickly adjustable means for accepting envelopes of varying sizes. This can be readily accomplished by movement of the adjusting bolts in the slots in the supporting members for the rear portion, namely, the slotted portion 812 (FIGS. 34, 36). A second adjustability for envelope size can be accomplished by rotation of the knob 386 (FIG. 15) and its reaction against the threaded portion passing through the spacer locater rod 102 with which it is associated. This will move the base plate platen 370 for adjustment relative to the fixed frame, and will also move the hanging frame which is readily adjustable because of the chain link connections between the two parts. Lateral adjustments can be made by controlling fasteners 932 and guides 930 (FIG. 4).

Located within the framework of this bar code print assembly is a P.C. board interconnect assembly 950 (FIG. 3) which is utilized to connect to the information supplying devices in the inserter mechanism, i.e., from the read out device 86 (FIG. 1). This in turn is connected through the wire bundling system to the print module 770. The power intake or main shaft 132 has a flagged start-of-print wheel 144 (FIG. 6) on the drive shaft and AP-C photosensor 146 which measures the rotational position of the drive shaft and with adjustable hub interrupter 148 can set the timing for the remainder of the apparatus. The safety clutch assembly 141 on drive shaft 132 (FIG. 6) serves as an overload clutch with the sprocket 142 that is used for the driving of the cam shaft 196 in the hanging assembly, as generally shown in FIG. 16.

The print module lift mechanism and the transverse movement of the printer head mechanism is well spelled out in the specification, and attention is once again called to the novel means for the termination of the cable 219 (FIG. 37) in that it is not rigidly terminated, but rather, terminates on the wheel 572 and rotates rather than being flexed intermittently about a fixed point. The printer mechanism lift assembly is readily activated by the notched plate 562 when the pin 732 rests in the notch 566 in plate 562, and thereby causes rotation of the operating arm 730 when plate 562 is rotated by the cable 219 (FIGS. 37, 46).

It is also possible to bias the position of the head block 522, and hence the print head 770, to locate the printed bar code 84 in the correct relation to envelope edge 82 for different envelope sizes through the use of the adjusting screw 452 associated with the knob 454 (FIG. 34). This in turn rotates the worm 450 engaged with the spur gear 476 to thereby vary the effective length of cable 480 at its termination 482.

Inadvertent paper jams can be readily cleared by tilting the entire upper head and using the over center counterbalance cam mechanism shown in FIG. 35 to assist in maintaining the heavy weight of the upper frame in the tilted position.

The pusher pin carriage 396 (FIG. 27) has been designed to have a reduced mass to better accommodate the seventeen high acceleration developed in the carriage during operation, which acceleration produces a large mechanical stress on the modified crank arm 360. This produces a 3rd derivative in slap and a 2nd derivative in acceleration. The pounding caused by these forces in prior devices when run at high speeds demonstrated that it was mandatory that the mass of the carriage be reduced. Therefore, bearings have been made integral with the carriage assembly, which eliminates a large portion of the mass previously utilized in devices of this type. By having the pusher pin 414 mounted on the spring 412 (FIGS. 30, 31), a high safety factor is afforded both to the machine as well as protection for the operator in that the pin 414, when the machine is operating, will flex out of the way if the operator's finger gets in the way or if it jams with other parts in the machine. Therefore, the spring pusher finger 408 with the cap 414 is a vast improvement over the prior art and also eliminates weight in the overall carriage assembly.

Other features will be apparent to those skilled in the art when the attached drawings are read with the specification as applied to and read with the attached claims.

I claim:

1. A printer apparatus for printing pre-selected indicia on a document to be placed on a transport raceway of an insertion machine, including a lower frame means and an upper support frame means, said lower frame means carrying, but not limited to the following, namely, a base plate assembly, a controlled means, a power source means, pusher means, and pivot means on opposite sides of said lower frame means, said upper support frame means including complimentary means for cooperating with said pivot means to support said upper support frame means for pivotal movement relative to said base plate assembly, said upper transport frame means further including means for carrying a hopper, open on at least two sides, to hold a plurality of said documents in an easily accessible stacked arrangement, said upper support frame also carrying printing means for printing said documents, said printing means being modular and readily removeable from said upper support frame means, said controlled means actuated by said power source to repeatedly and individually deposit said documents one at a time from said hopper onto said base plate assembly, said resilient pusher means driven by said power source in timed relation to said controlled means for advancing each said document across said base plate assembly to a printing station beneath said printing means, flexible control means extending from said power source up to and connectable to said printing means for providing motive power for lateral movement thereof during the printing cycle carried out by said printing means, means for moving said document after printing from said printing station to said transport raceway, at least one extremity of said flexible control means connectable to said printing means is terminated in a large radius limited motion fixation device to thereby eliminate stress normally found in flexure about a limited point of fixation, said fixation device including an enlarged grooved sheave with said flexible control means passing over said sheave and having its termination fixed generally perpendicular to the normal position of said flexible control means, said fixation device further including body means pivotally mounted and fixed relative to said sheave, said body means extending beyond the periphery of said sheave and carrying an enlarged termination means at the extremity of said flexible control means, and means for providing adjustable spring loaded pivotal control means for limiting rotary motion of said sheave and body means, said hopper and said upper support frame means being readily tipped about said pivot away from said base plate assembly whereby any jams or other impediments to proper operation of the device can be removed by an operator to permit continuation of proper operation thereof.

2. An apparatus of the type claimed in claim 1 wherein said hopper includes indicia means for indicating the impending depletion of documents positioned within said hopper, said indicia means includes sensing means for determining the absence of a predetermined quantity of documents in said hopper, said sensing means includes a pivotable pendulum-type sensor having a sloping ramp surface normally adapted to project into said hopper in the absence of documents at a predetermined level within said hopper, the position of said sensor being adjustable relative to the length of said hopper to permit sensing of various levels of documents within said hopper, said sensing means including switch means that are activated or deactivated dependent upon the absence or presence, respectively, of documents in said hopper at the adjusted position of said sensing means relative to said hopper and the position of said pendulum-type sensor for notifying an operator of the need for additional documents in said hopper for further operation of said apparatus.

3. An apparatus of the type claimed in claim 1 wherein said upper support frame means is pivotally positioned above said base plate assembly latching means including curvilinear keeper means fixedly mounted on a radius of said pivot means on said base plate assembly and a spring loaded follower carried by said upper support frame on a radius of said pivot means, said curvilinear keeper means including a nodelike high over center portion adapted to permit retention of said upper support frame member in a tipped position when said follower has been deflected against its spring pressure and then returned substantially to its extended position when said overcenter portion has been passed.

4. An apparatus of the type claimed in claim 1 wherein said body means includes an adjustable stop means on one side of the pivot axis of said sheave and body means, and spring means on the opposite side of said axis urging said body means into engagement with said stop means, whereby excessive tensile stress on said flexible control means results in a limited rotation of said body means about said pivot axis when said upper frame means is tilted relative to said bottom frame means.

5. A device of the type claimed in claim 1 wherein said hopper includes one closed side, a pair of spaced vertically disposed flange members carried by said closed side for limiting lateral movement of said documents when one edge thereof is stacked against said closed side, said hopper being substantially open on its remaining three sides at least one of said remaining three sides being defined by a plurality of rod-like members which restrain said documents on the opposite edge to said one edge, whereby operator access to said documents is readily available on three of the four sides of said documents for centering, refilling, and removal of documents where necessary.

* * * * *